US010981404B2

(12) United States Patent
Horiuchi et al.

(10) Patent No.: US 10,981,404 B2
(45) Date of Patent: Apr. 20, 2021

(54) SYSTEM AND APPARATUS FOR PRODUCING MULTILAYERED PRINTED MATTER

(71) Applicant: MIMAKI ENGINEERING CO., LTD., Nagano (JP)

(72) Inventors: Yuhei Horiuchi, Nagano (JP); Masashi Doi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 222 days.

(21) Appl. No.: 16/102,759

(22) Filed: Aug. 14, 2018

(65) Prior Publication Data

US 2019/0061402 A1 Feb. 28, 2019

(30) Foreign Application Priority Data

Aug. 30, 2017 (JP) ..... JP2017-165410
Oct. 2, 2017 (JP) ..... JP2017-192539

(51) Int. Cl.
*B41J 11/66* (2006.01)
*B41M 5/50* (2006.01)
(Continued)

(52) U.S. Cl.
CPC ..... *B41M 5/506* (2013.01); *B26D 1/085* (2013.01); *B26D 3/085* (2013.01); *B41J 11/663* (2013.01); *B41J 11/666* (2013.01); *B41M 5/504* (2013.01); *B42D 15/0073* (2013.01); *B42D 25/45* (2014.10); *G09F 13/12* (2013.01); *B41M 2205/36* (2013.01); *B41M 2205/38* (2013.01); *B41M 2205/40* (2013.01); *B41M 2205/42* (2013.01); *G09F 13/06* (2013.01)

(58) Field of Classification Search
CPC ..... B41J 11/66; B41J 11/663; B41J 11/666; B41J 11/68; B41J 11/70; B41J 11/706; B41J 2/2114; B41J 2/2117; B41J 2/01
See application file for complete search history.

(56) References Cited

U.S. PATENT DOCUMENTS

2014/0031189 A1* 1/2014 Izawa ..... B23K 26/18 493/324
2014/0055548 A1* 2/2014 Mindler ..... B41J 11/703 347/217

(Continued)

FOREIGN PATENT DOCUMENTS

JP 2009128734 6/2009

*Primary Examiner* — Scott A Richmond
(74) *Attorney, Agent, or Firm* — JCIPRNET

(57) ABSTRACT

A multilayered printed matter is made up of a plurality of layers formed on a medium, including a front layer and a back layer with patterns printed thereon, and a white layer and a black layer interposed between the front layer and the back layer so as to conceal the back layer to be invisible from the front-layer side. The system for producing the multilayered printed matter includes a computer that executes a printing step of moving the medium and an inkjet head relative to each other using a moving device and printing the front, back, white, and black layers on the medium using the inkjet head, and a cutting step, subsequent to the printing step, of moving the medium and a cutting blade relative to each other using the moving device and cutting the medium using the cutting blade.

5 Claims, 23 Drawing Sheets

(51) Int. Cl.

| | |
|---|---|
| ***G09F 13/12*** | (2006.01) |
| ***B26D 1/08*** | (2006.01) |
| ***B42D 15/00*** | (2006.01) |
| ***B42D 25/45*** | (2014.01) |
| ***B26D 3/08*** | (2006.01) |
| *G09F 13/06* | (2006.01) |

(56) References Cited

U.S. PATENT DOCUMENTS

2016/0009107 A1* 1/2016 Nakai ..... B41M 5/0011
347/102
2017/0136788 A1* 5/2017 Masubuchi ..... B41J 11/663

* cited by examiner

SYSTEM AND APPARATUS FOR PRODUCING MULTILAYERED PRINTED MATTER

CROSS REFERENCE TO RELATED APPLICATIONS

This application claims the priority benefit of Japanese Patent Application Nos. 2017-165410, filed on Aug. 30, 2017 and 2017-192539, filed on Oct. 2, 2017. The entirety of each of the above-mentioned patent applications is hereby incorporated by reference herein and made a part of this specification.

TECHNICAL FIELD

This disclosure relates to a system and an apparatus for producing a multilayered printed matter in which multiple layers are printed on a medium.

DESCRIPTION OF THE BACKGROUND ART

Conventionally, transparent or semitransparent sheets are known in the relevant technical field that include patterns printed on both of their front and back surfaces (for example, Japanese Unexamined Patent Publication No. 2009-128734). When the sheet described in Japanese Unexamined Patent Publication No. 2009-128734 is receiving light from the front-surface side alone, with no light from a light source disposed on the back-surface side, it is mostly a pattern on the front surface that is visible from the front-surface side. On the other hand, when the sheet described in Japanese Unexamined Patent Publication No. 2009-128734 is being exposed to light emitted from the light source disposed on the back-surface side, with light coming from the front-surface side being substantially blocked, light from the light source allows a pattern on the back surface to be visible from the front-surface side, and the pattern may be more easily caught by the eye from the front-surface side than when observed without light emitted from the light source.

Patent Literature: Japanese Unexamined Patent Publication No. 2009-128734

SUMMARY

An issue with the sheet described in Japanese Unexamined Patent Publication No. 2009-128734 is that the pattern on the back surface may emerge into view under light from the front-surface side alone when observed from the front-surface side, even without light from the light source disposed on the back-surface side.

To address the issue of the known art, the inventors of this disclosure invented a multilayered printed matter made up of layers that are formed on a medium, including two pattern layers with patterns formed thereon and a concealment layer. In this multilayered printed matter, the concealment layer is interposed between the two pattern layers so as to conceal one of the pattern layers to be invisible from the side of the other pattern layer.

Multilayered printed matters conventionally made up of a large number of layers require considerably long printing time, as compared with the other regular printed matters. For example, an operator, after all of the layers are printed on the medium by a device exclusive for printing use, may manually relocate the layer-printed medium from the device to a cutting machine to cut and separate the medium from a multilayered printed matter formed thereon. In this instance, the operator who needs to manually relocate the layer-printed medium from the device exclusive for printing use to the cutting machine has to wait over a long time after the printing started until such a large number of layers are all printed on the medium. The operator, who started the operation in the morning, may be forced to work until very late at night that day, or until the next morning.

To this end, this disclosure provides a system and an apparatus for producing a multilayered printed matter that may reduce an operator's workload in producing the multilayered printed matter.

A system for producing a multilayered printed matter is for use in printing a multilayered printed matter in which layers are formed on a medium, the layers including two pattern layers with patterns formed thereon, and a concealment layer. The concealment layer is interposed between the two pattern layers so as to conceal one of the pattern layers to be invisible from a side of the other one of the pattern layers. The system includes: an inkjet head that ejects ink to the medium to print the layers on the medium; a medium cutting device that cuts the medium; a moving device that causes relative movement between the medium, and the inkjet head and the medium cutting device; and a printing and cutting controller that controls operations to print the layers on the medium using the inkjet head and to cut the medium using the medium cutting device. The printing and cutting controller executes a printing step of moving the medium and the inkjet head relative to each other using the moving device and printing the two pattern layers and the concealment layer on the medium using the inkjet head, and a cutting step, subsequent to the printing step, of moving the medium and the medium cutting device relative to each other using the moving device and cutting the medium using the medium cutting device.

In the multilayered printed matter production system thus configured, the medium and the inkjet head are moved relative to each other by the moving device in the printing step, and then, the medium and the medium cutting device are moved relative to each other by the moving device in the cutting step. This makes it unnecessary for an operator to manually move the medium with the layers printed thereon in the printing step to shift to the subsequent cutting step, and may reduce the operator's workload in producing the multilayered printed matter, as compared with the known art that requires the operator to manually move the medium from a device exclusive for printing use to a cutting device.

In the multilayered printed matter production system disclosed herein, the moving device may be equipped with a feeding part that supports the medium wound in a roll before the layers are printed thereon by the inkjet head so as to unwind and feed the medium, and a take-up part that rolls up and supports the medium after the layers are printed thereon by the inkjet head.

The multilayered printed matter production system thus configured may be well-equipped to handle lengthy media that possibly require considerably long printing time. This system may greatly contribute to reduction of the operator's workload in producing the multilayered printed matter particularly in the case of a time-consuming printing step involving use of such long media.

In the multilayered printed matter production system disclosed herein, the printing and cutting controller may execute an operation to return the medium rolled up by the take-up part in the printing step to the feeding part in the cutting step.

The multilayered printed matter production system disclosed herein may be further characterized in that the medium cutting device has a cutting blade used to cut the medium, the printing and cutting controller executes a test cutting step of deciding a depth of insertion of the cutting blade into the medium prior to the cutting step, and the test cutting step is a step of printing, on the medium using the inkjet head, a group of print layers equal in thickness to an optional group of print layers in a portion of the multilayered printed matter to be cut in the cutting step and then inserting the cutting blade into the medium through the group of print layers so as to cut the medium.

In the multilayered printed matter production system thus configured, in the test cutting step, a group of print layers equal in thickness to an optional group of print layers in a portion of the multilayered printed matter to be cut in the cutting step are printed on the medium by the use of the inkjet head. Then, in the test cutting step subsequent to the printing step, the cutting blade is entered into the medium through the group of print layers so as to cut the medium. Thus, how the thickness of the group of print layers in the multilayered printed matter affects the cutting operation may be easily known.

An apparatus for producing a multilayered printed matter is for use in printing a multilayered printed matter in which layers are formed on a medium, the layers including two pattern layers with patterns formed thereon, and a concealment layer. The concealment layer is interposed between the two pattern layers so as to conceal one of the pattern layers to be invisible from a side of the other one of the pattern layers. The apparatus includes: an inkjet head that ejects ink to the medium to print the layers on the medium; a medium cutting device that cuts the medium; a moving device that causes relative movement between the medium, and the inkjet head and the medium cutting device; and a printing and cutting controller that controls operations to print the layers on the medium using the inkjet head and to cut the medium using the medium cutting device. The printing and cutting controller executes a printing step of moving the medium and the inkjet head relative to each other using the moving device and printing the two pattern layers and the concealment layer on the medium using the inkjet head, and a cutting step, subsequent to the printing step, of moving the medium and the medium cutting device relative to each other using the moving device and cutting the medium using the medium cutting device.

In the multilayered printed matter production apparatus thus configured, the medium and the inkjet head are moved relative to each other by the moving device in the printing step, and then, the medium and the medium cutting device are moved relative to each other by the moving device in the cutting step. This makes it unnecessary for an operator to manually move the medium with the layers printed thereon in the printing step to shift to the subsequent cutting step, and may reduce the operator's workload in producing the multilayered printed matter, as compared with the known art that requires the operator to manually move the medium from a device exclusive for printing use to a cutting device.

The system and the apparatus for producing the multilayered printed matter disclosed herein may reduce an operator's workload in producing the multilayered printed matter.

DETAILED DESCRIPTION OF EMBODIMENTS

An embodiment of this disclosure is hereinafter described referring to the accompanying drawings.

First, a multilayered printed matter according to this embodiment is described.

Figure 1:
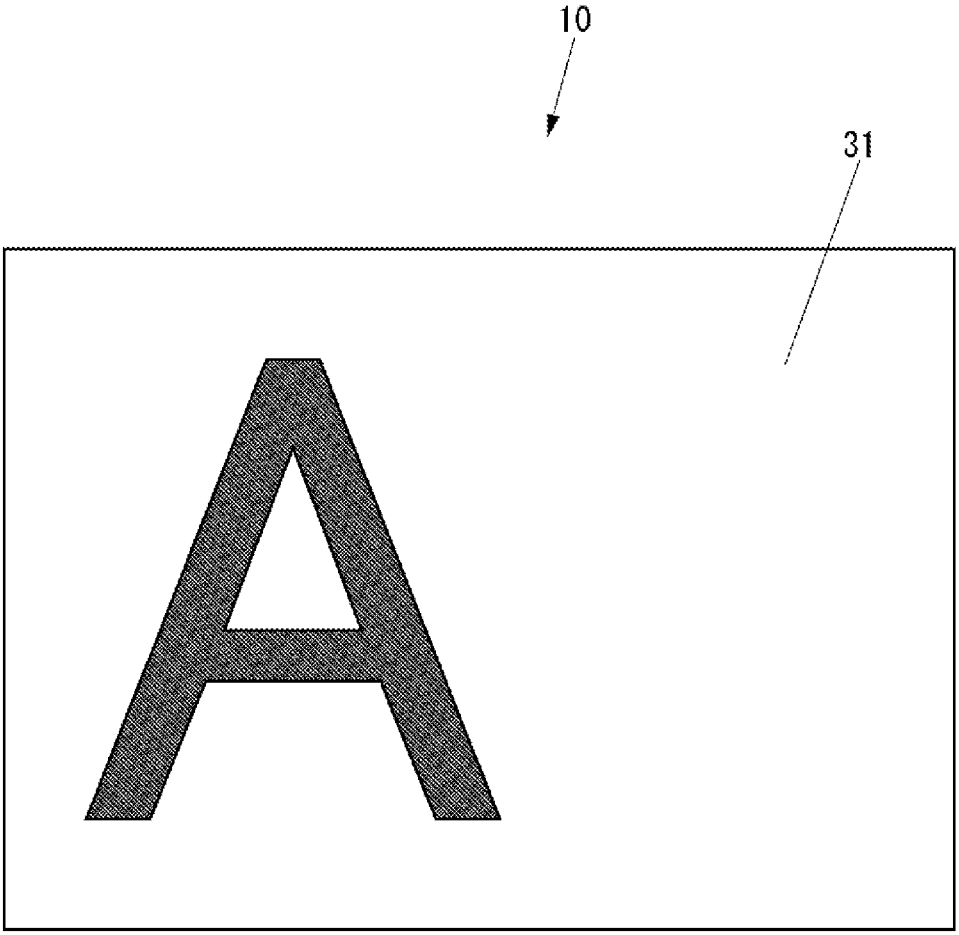
FIG. 1 is a plan view of a multilayered printed matter according to an embodiment of this disclosure.
Figure 2:
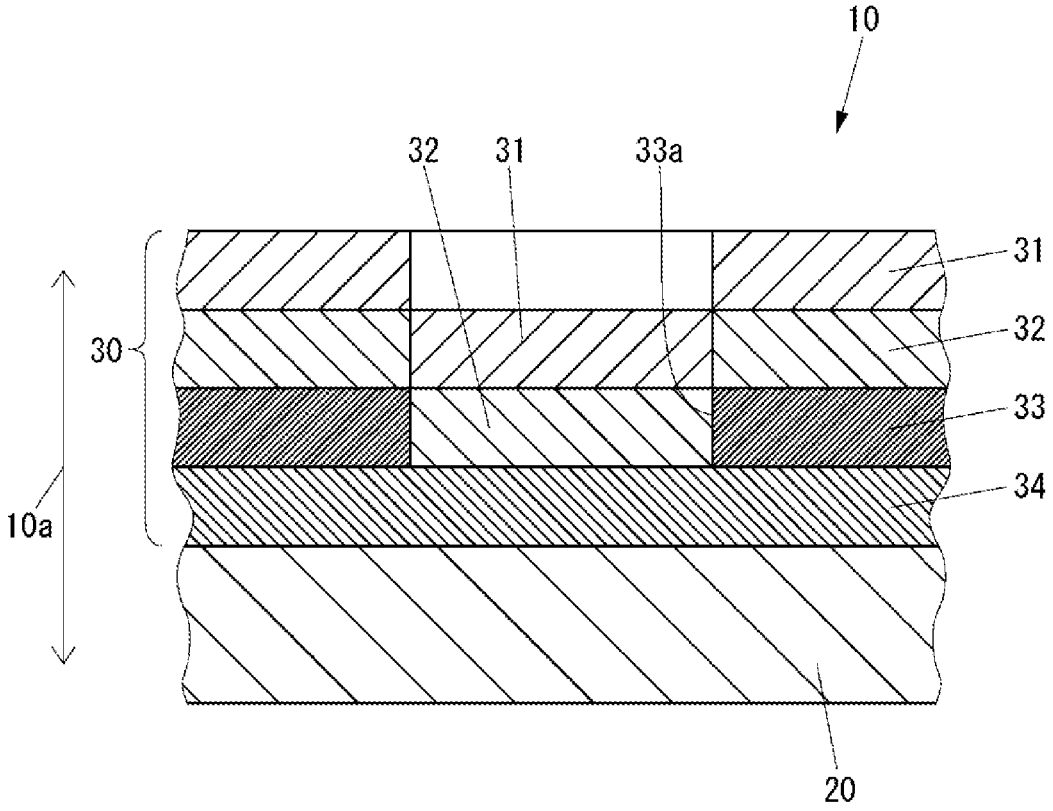
FIG. 2 is a side view of the multilayered printed matter illustrated in FIG. 1.

FIG. 1 is a plan view of a multilayered printed matter 10 according to this embodiment. FIG. 2 is a side view of the multilayered printed matter 10.

As illustrated in FIGS. 1 and 2, the multilayered printed matter 10 includes a medium 20, and a group of print layers 30 formed on the medium 20.

The medium 20 may be a transparent medium or an opaque medium.

The group of print layers 30 include a front layer 31, a white layer 32, a black layer 33, and a back layer 34.

Figure 3A:
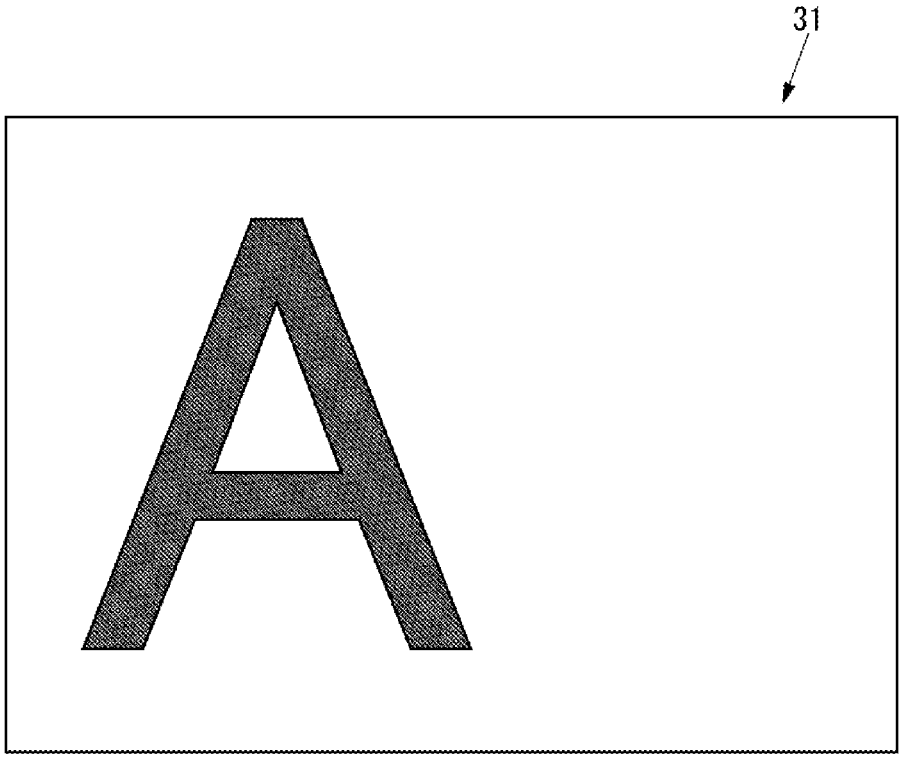
FIG. 3A is a plan view of a front layer illustrated in FIG. 2.
Figure 3B:
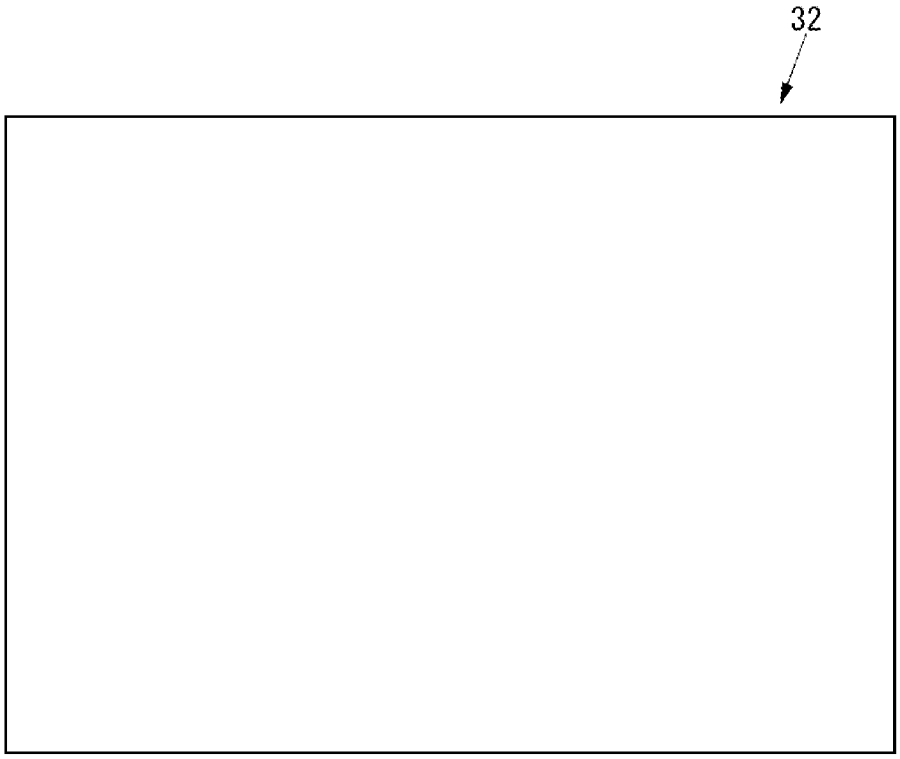
FIG. 3B is a plan view of a white layer illustrated in FIG. 2.
Figure 4A:
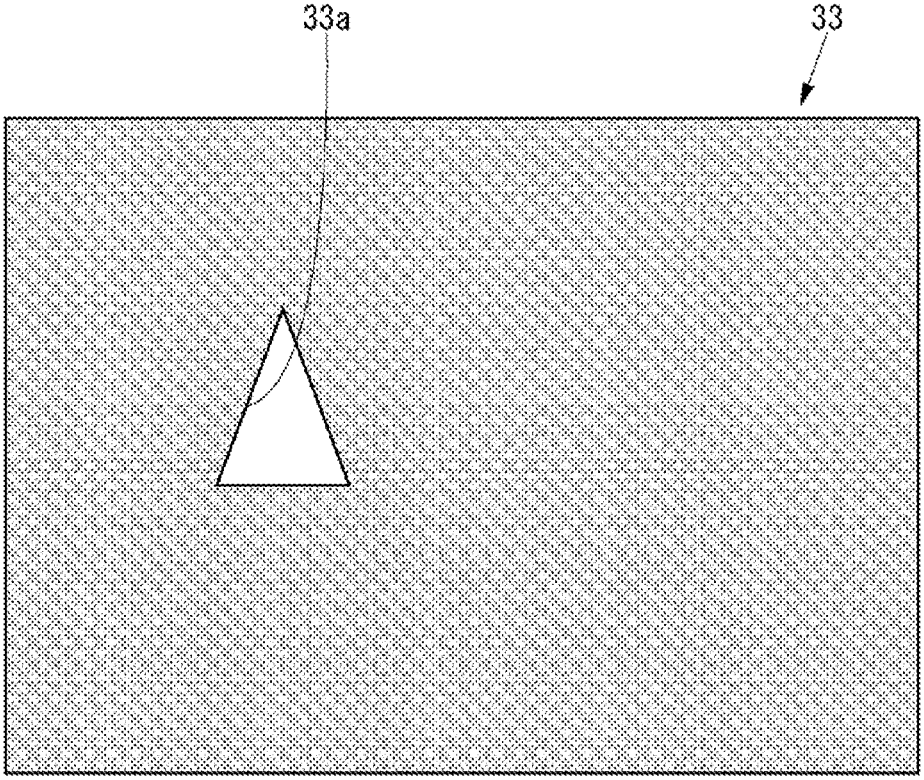
FIG. 4A is a plan view of a black layer illustrated in FIG. 2.
Figure 4B:
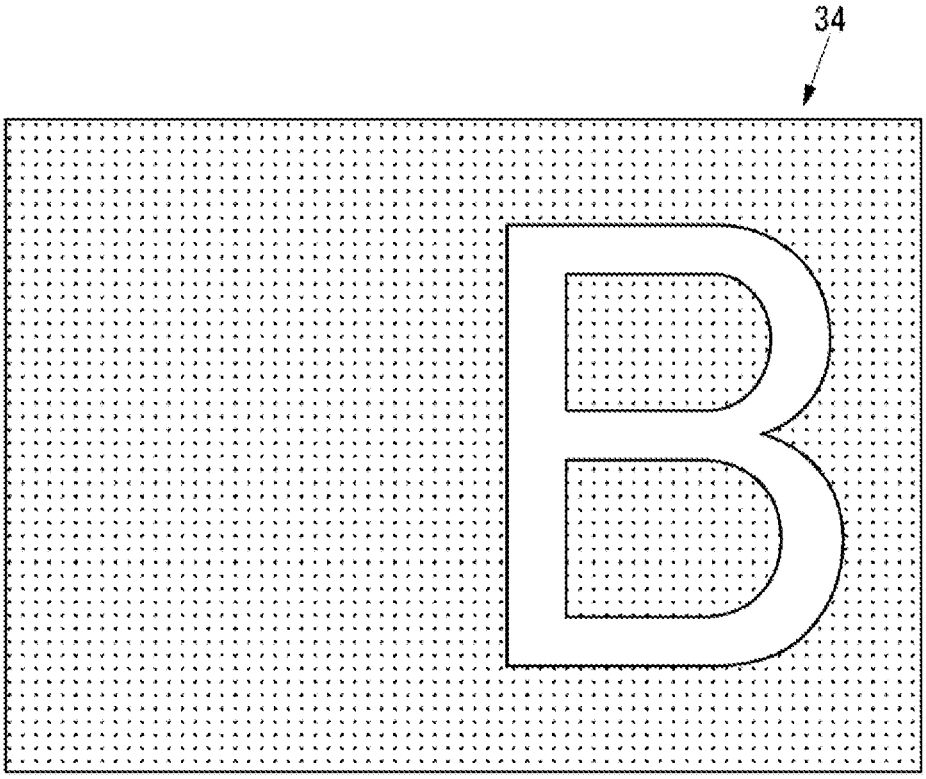
FIG. 4B is a plan view of a back layer illustrated in FIG. 2.

FIG. 3A is a plan view of the front layer 31. FIG. 3B is a plan view of the white layer 32. FIG. 4A is a plan view of the black layer 33. FIG. 4B is a plan view of the back layer 34.

The front layer 31 exhibits a pattern illustrated in FIG. 3A. The front layer 31 constitutes the pattern layer disclosed herein.

As illustrated in FIG. 2, the white layer 32 illustrated in FIG. 3B is interposed between the front layer 31 and the back layer 34 so as to conceal the back layer 34 to be invisible from the side of the front layer 31. Further, the white layer 32 reflects light from the side of the front layer 31 to allow the front layer 31 to be visible from the side of the front layer 31. The white layer 32 constitutes the concealment layer disclosed herein. The white layer 32 is printed with a white ink. Assuming that 100% represents the white ink being ejected to all of pixels targeted for printing on the medium 20, the white layer 32 is printed by, for example, 200%.

As illustrated in FIG. 2, the black layer 33 illustrated in FIG. 4A is interposed between the white layer 32 and the back layer 34 so as to conceal the back layer 34 to be invisible from the side of the front layer 31. The black layer 33 also constitutes the concealment layer disclosed herein. The black layer 33 printed with a black ink exerts a higher light blocking effect than the white layer 32 printed with the white ink. As illustrated in FIG. 2, the black layer 33 includes a portion 33*a* where the black layer 33 is unformed for the front layer 31 in a layer-stacking direction indicated by arrow 10*a*. Assuming that 100% represents the black ink being ejected to all of pixels targeted for printing on the medium 20, the black layer 33 is printed by, for example, 30% to 70%. In comparison between the black layer 33 and the white layer 32 that are equal in thickness, the black layer 33 exerts a higher light blocking effect than the white layer 32.

The back layer 34 exhibits a pattern illustrated in FIG. 4B. The back layer 34 constitutes the pattern layer disclosed herein.

Next, a display device with the multilayered printed matter 10 set therein is hereinafter described.

Figure 5:
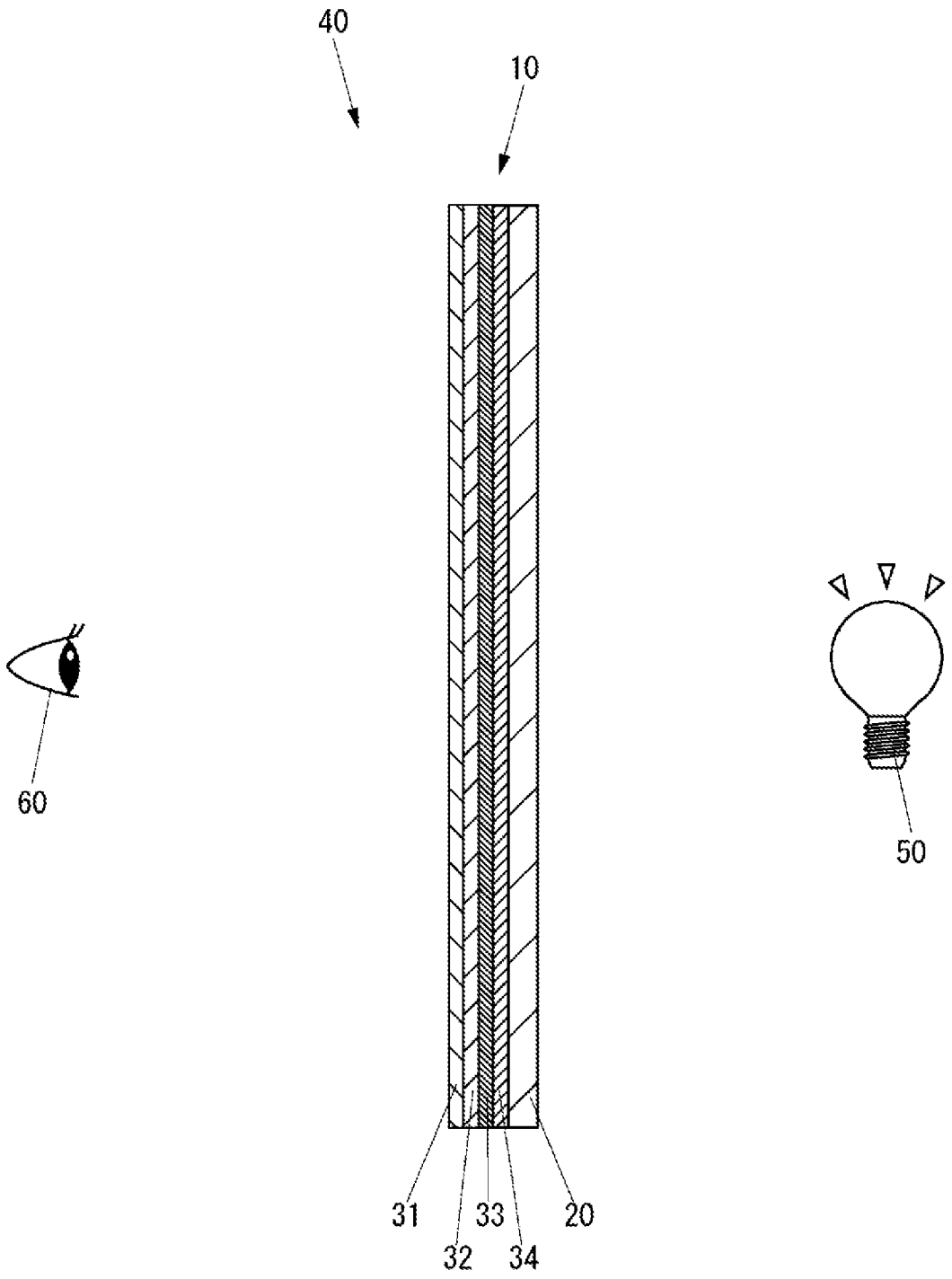
FIG. 5 is a side view of a display device with the multilayered printed matter of FIG. 1 set therein.

FIG. 5 is a side view of a display device 40 with the multilayered printed matter 10 set therein.

As illustrated in FIG. 5, the display device 40 includes the multilayered printed matter 10 and a light source 50. The light source 50 is disposed on the opposite side of the front layer 31 across the back layer 34 of the multilayered printed matter 10.

In the display device 40, the multilayered printed matter 10 is observed by a user 60 from the opposite side of the back layer 34 across the front layer 31 of the multilayered printed matter 10.

Next, the operation of the display device 40 is described.

When the multilayered printed matter 10 is under light coming from the side of the front layer 31, with no light from the light source 50 disposed on the side of the back layer 34, the user 60 sees the pattern on the front layer 31, as illustrated in FIG. 1.

Figure 6:
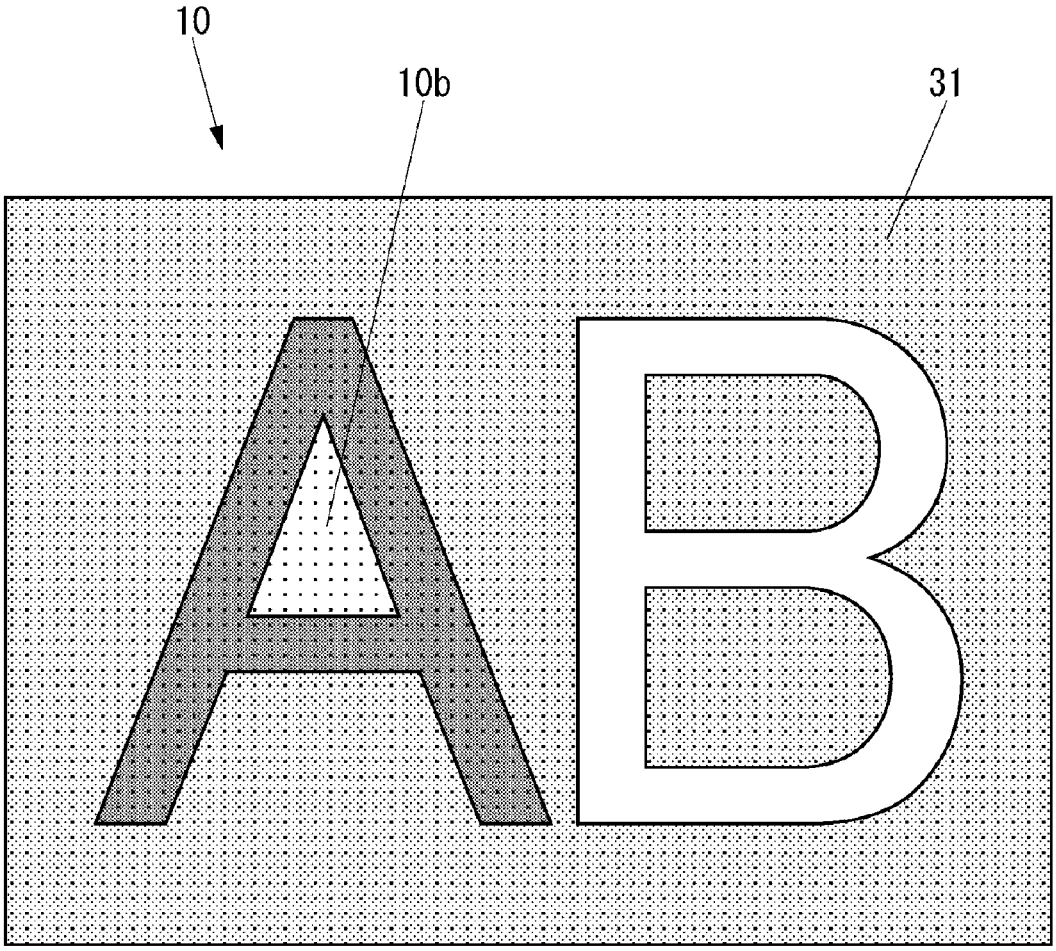
FIG. 6 is a plan view of the multilayered printed matter under light emitted from a light source illustrated in FIG. 5, with light from the side of the front layer being substantially blocked.

FIG. 6 is a plan view of the multilayered printed matter 10 under light emitted from the light source 50 on the side of the back layer 34, with light coming from the side of the front layer 31 being substantially blocked.

When the multilayered printed matter 10 is under light emitted from the light source 50 on the side of the back layer 34, with light coming from the side of the front layer 31 being substantially blocked, light from the light source 50 allows the pattern on the back layer 34 to be visible from the side of the front layer 31, as illustrated in FIG. 6. Thus, the user 60 sees a composite picture of the patterns on the front and back layers 31 and 34.

Next, a system for producing the multilayered printed matter 10 is hereinafter described.

Figure 7:
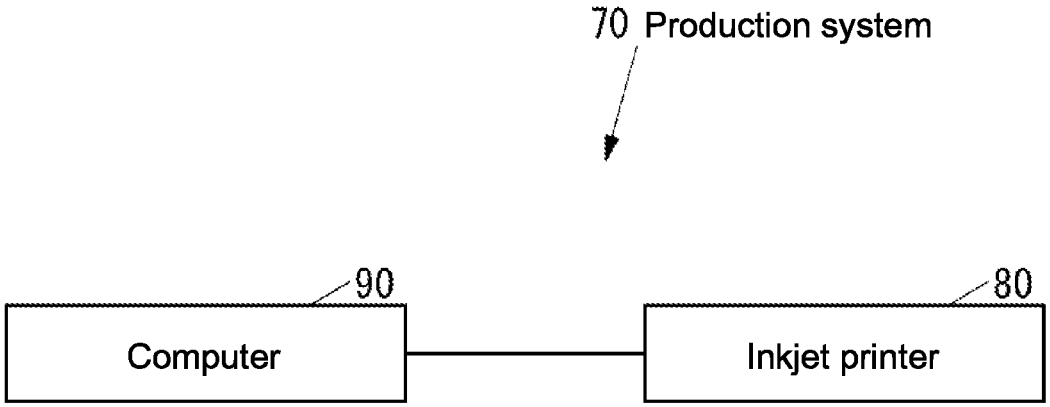
FIG. 7 is a block diagram of a system for producing the multilayered printed matter illustrated in FIG. 1.

FIG. 7 is a block diagram of a system 70 for producing the multilayered printed matter 10.

As illustrated in FIG. 7, the production system 70 includes an inkjet printer 80 that carries out printing for the medium 20 (see FIG. 2), and a computer 90, such as a PC (Personal Computer), programmed to transmit printing data to the inkjet printer 80. The production system 70 constitutes the multilayered printed matter production system disclosed herein.

The inkjet printer 80 may be a printer operable to carry out printing for the medium 20 wound in a roll. The inkjet printer 80 may be UCJV-300 supplied by MIMAKI ENGINEERING CO., LTD., or may be selected from any other suitable inkjet printers. The inkjet printer 80 is equipped with a function of a cutting plotter. The inkjet printer 80 constitutes the multilayered printed matter production apparatus disclosed herein.

Figure 8:
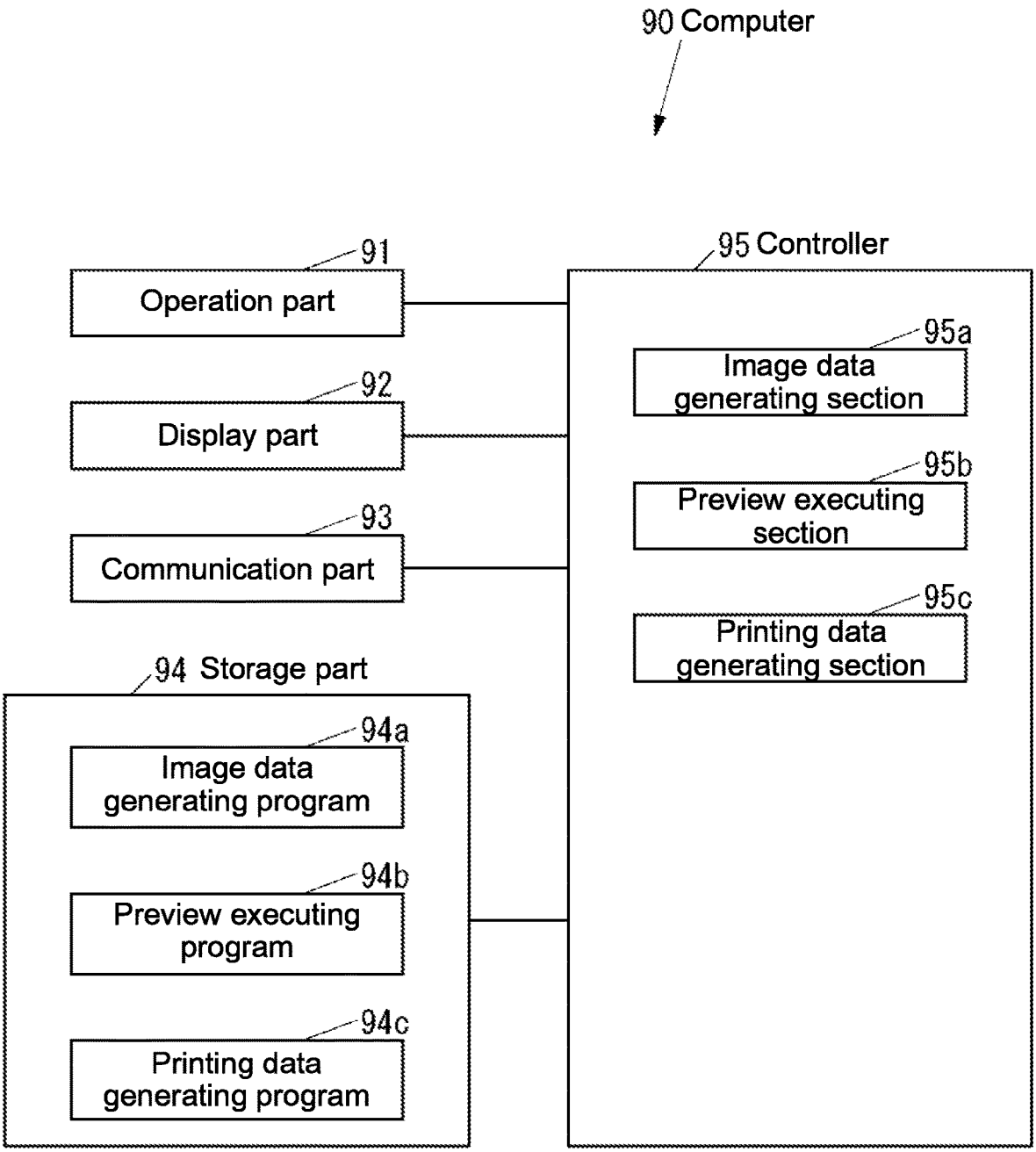
FIG. 8 is a block diagram of a computer illustrated in FIG. 7.

FIG. 8 is a block diagram of the computer 90.

Referring to FIG. 8, the computer 90 includes an operation part 91 that is an input device, such as a keyboard or a mouse, used to input various instructions, a display part 92 that is a display device, such as an LCD (Liquid Crystal Display) for display of various pieces of information, a communication part 93 that is a communication device communicating with external devices through a network such as a LAN (Local Area Network), or directly communicating with external devices wired or wirelessly not through the network, a storage part 94 that is a non-volatile storage device, such as a semiconductor memory or an HDD (Hard Disc Drive) storing various pieces of information, and a controller 95 that controls the whole computer 90.

The storage part 94 stores an image data generating program 94*a* for generating image data, a preview executing program 94*b* for executing the previewing of the multilayered printed matter, and a printing data generating program 94*c* for generating printing data. The image data generating program 94*a*, the preview executing program 94*b*, and the printing data generating program 94*c* may be installed into the computer 90 during the manufacture of this computer, may be installed as additional programs into the computer 90 in a later stage from an external storage medium such as a USB (Universal Serial Bus) memory, a CD (Compact Disk) or a DVD (Digital Versatile Disk), or may be installed as additional programs into the computer 90 in a later stage through a network.

The controller 95 includes a CPU (Central Processing Unit), a ROM (Read Only Memory) in which programs and various pieces of data are prestored, and a RAM (Random Access Memory) serving as a working region for the CPU. The CPU is configured to run the programs stored in the ROM or the storage part 94.

The controller 95 runs the image data generating program 94*a* and thereby effectuates an image data generating section 95*a* that generates pieces of image data respectively for the front layer 31, white layer 32, black layer 33, and back layer 34. The controller 95 runs the preview executing program 94*b* and thereby effectuates a preview executing section 95*b* that executes the previewing of the multilayered printed matter printed based on the pieces of image data generated by the image data generating section 95*a*. The controller 95 runs the printing data generating program 94*c* and thereby effectuates a printing data generating section 95*c* that generates printing data based on the pieces of image data generated by the image data generating section 95*a*.

Next, a method for producing the multilayered printed matter 10 is hereinafter described.

Figure 9:
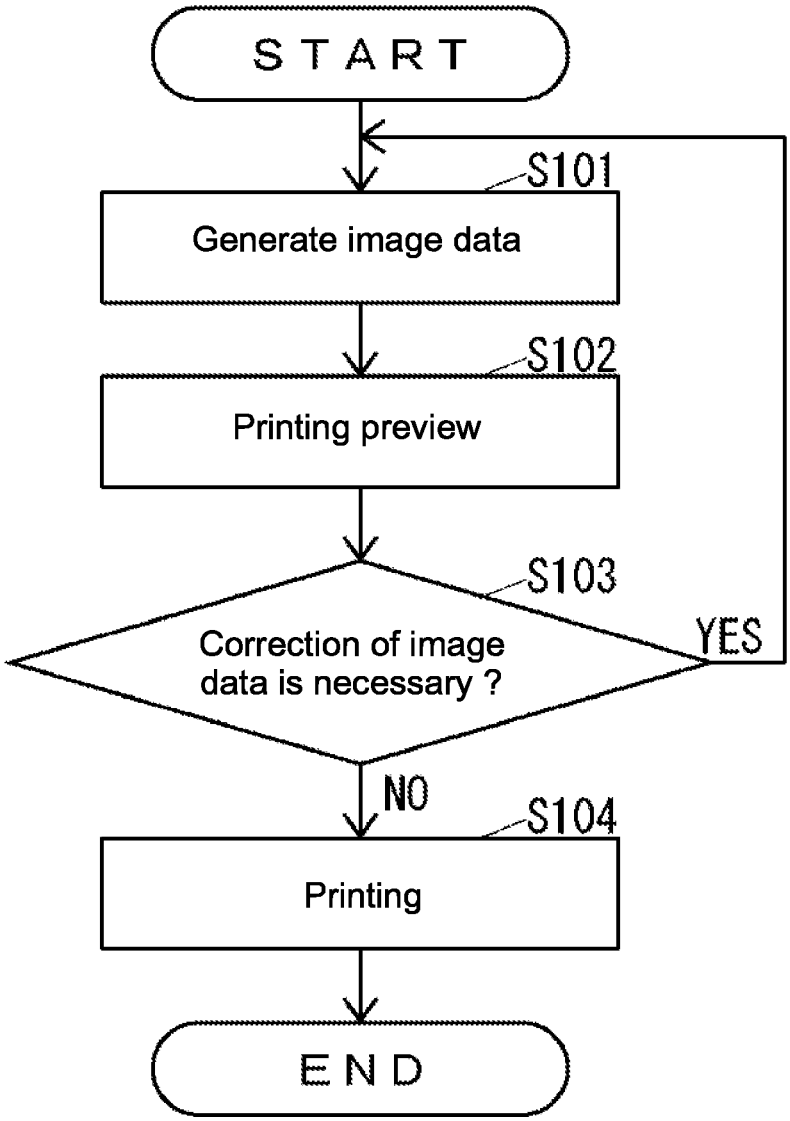
FIG. 9 is a flowchart of steps of printing the multilayered printed matter illustrated in FIG. 1.

FIG. 9 is a flowchart of steps of producing the multilayered printed matter 10.

Referring to FIG. 9, an operator runs the image data generating program 94*a* on the computer 90 and inputs via the operation part 91 instructions to generate the pieces of image data respectively for the front layer 31, white layer 32, black layer 33, and back layer 34 (S101). The image data generating section 95*a* accordingly generates the pieces of image data respectively for the front layer 31, white layer 32, black layer 33, and back layer 34 based on the instructions inputted via the operation part 91.

Subsequent to S101, the operator runs the preview executing program 94*b* on the computer 90 and inputs via the operation part 91 an instruction to execute the previewing of the multilayered printed matter printed based on the image data generated in S101 (S102). The preview executing section 95*b* accordingly executes the previewing of the multilayered printed matter printed based on the image data generated in S101.

Figure 10:
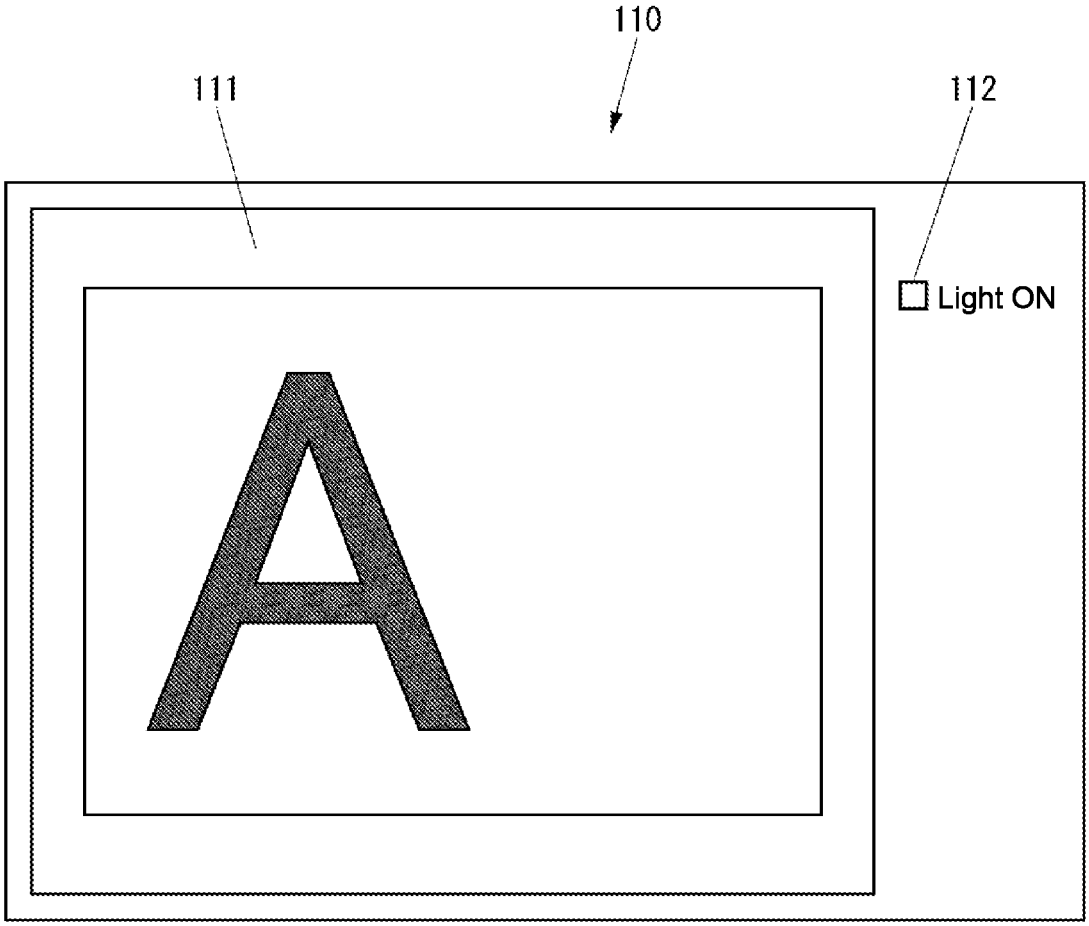
FIG. 10 is a drawing of an exemplified preview screen displayed by a preview executing section illustrated in FIG. 8.

FIG. 10 is a drawing of an exemplified preview screen 110 displayed by the preview executing section 95*b*.

The preview screen 110 illustrated in FIG. 10 includes a preview region 111 for displaying the preview of the multilayered printed matter printed based on the image data, and a check box 112 for selecting whether to display the preview of the multilayered printed matter printed based on the image data when this printed matter is set in the display device 40 illustrated in FIG. 5 and is illuminated with light emitted from the light source 50.

FIG. 10 shows the preview screen 110 with the check box 112 being unticked. On the preview region 111 of FIG. 10 is displayed the preview of the multilayered printed matter under light coming from the side of the front layer 31, with no light from the light source 50 disposed on the side of the back layer 34.

Figure 11:
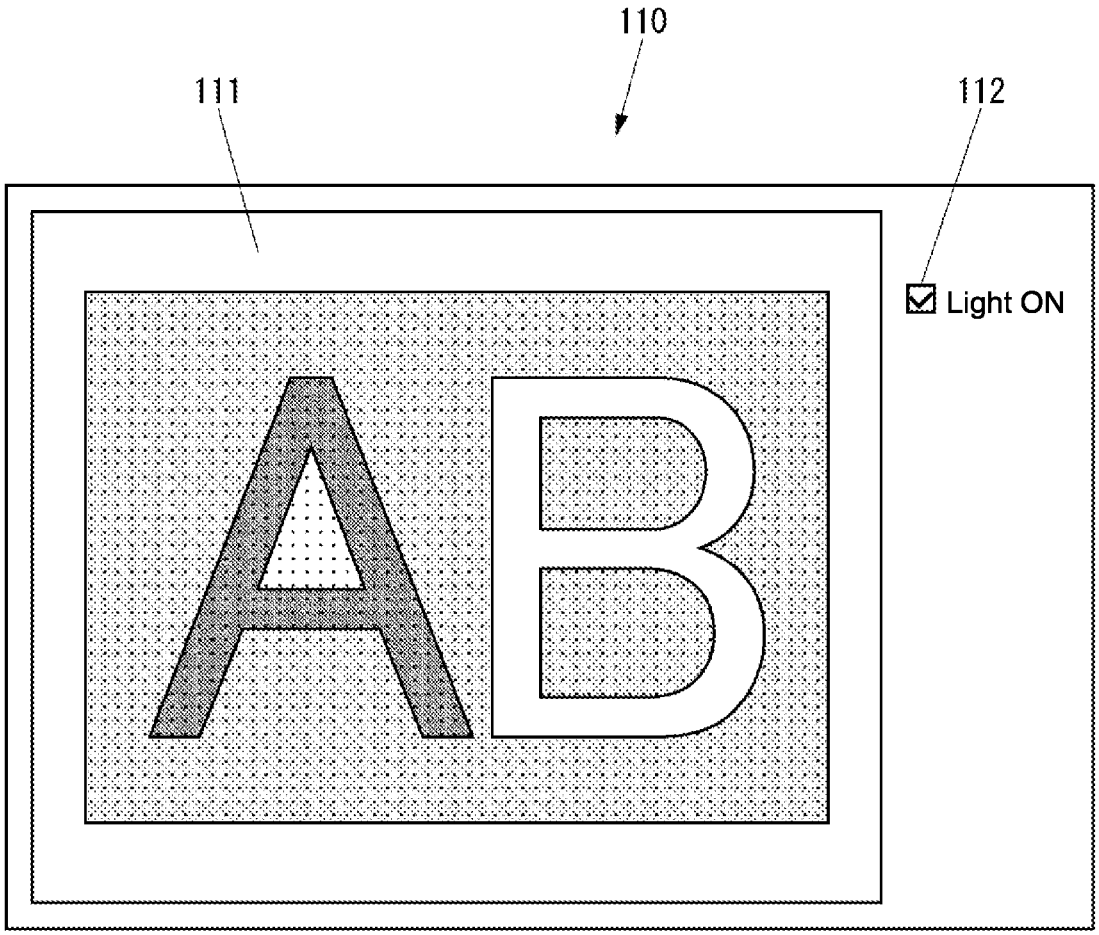
FIG. 11 is a drawing of an exemplified preview screen illustrated in FIG. 10 with a ticked check box.

FIG. 11 is a drawing of an example of the preview screen 110 on which the check box 112 is ticked.

FIG. 11 shows the preview screen 110 with the check box 112 being ticked. On the preview region 111 of FIG. 11 is displayed the preview of the multilayered printed matter under light emitted from the light source 50 disposed on the side of the back layer 34, with light coming from the side of the front layer 31 being substantially blocked.

Referring to FIG. 9, the operator determines whether to correct the image data based on the preview displayed in S102 (S103).

The operator, who determined in S103 that the image data needs to be corrected, returns to and performs S101.

The operator, who determined in S103 that the image data needs not be corrected, runs the printing data generating program 94*c* on the computer 90, and inputs via the operation part 91 printing instructions based on the image data generated in S101 (S104). The printing data generating section 95*c* accordingly generates printing data based on the image data generated in S101 and transmits the generated printing data to the inkjet printer 80. The inkjet printer 80 receives the printing data transmitted from the computer 90 and forms the group of print layers 30 on the medium 20 based on the received printing data. The inkjet printer 80 prints the back layer 34, black layer 33, white layer 32, and front layer 31 in this order on the medium 20 so as to produce the multilayered printed matter 10 illustrated in FIG. 5.

Figure 12:
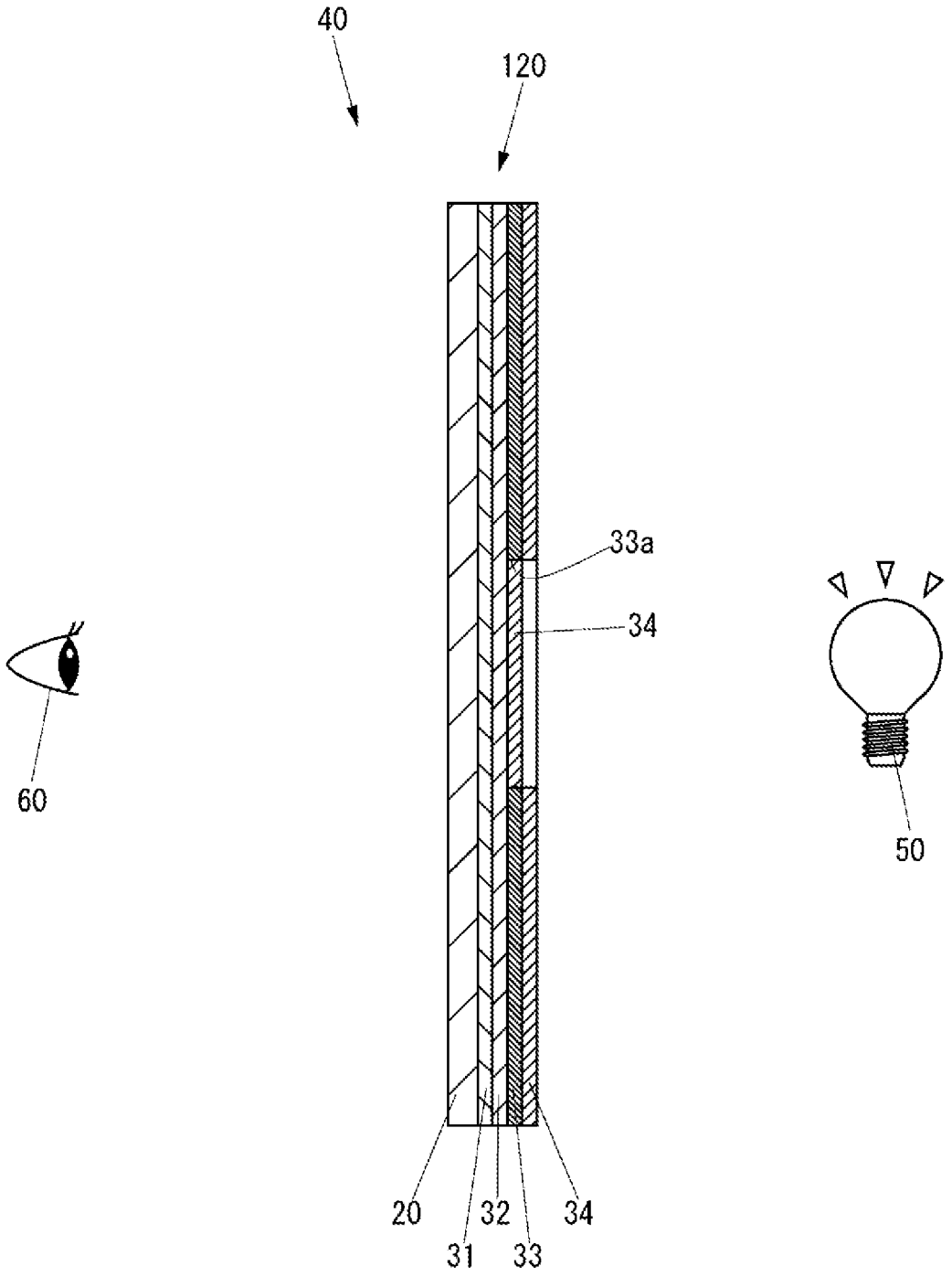
FIG. 12 is a side view of a display device with a multilayered printed matter set therein that is distinct from the multilayered printed matter illustrated in FIG. 1.

The inkjet printer 80 may produce a multilayered printed matter 120 illustrated in FIG. 12 by printing the front layer 31, white layer 32, black layer 33, and back layer 34 in this order on the medium 20.

Figure 13:
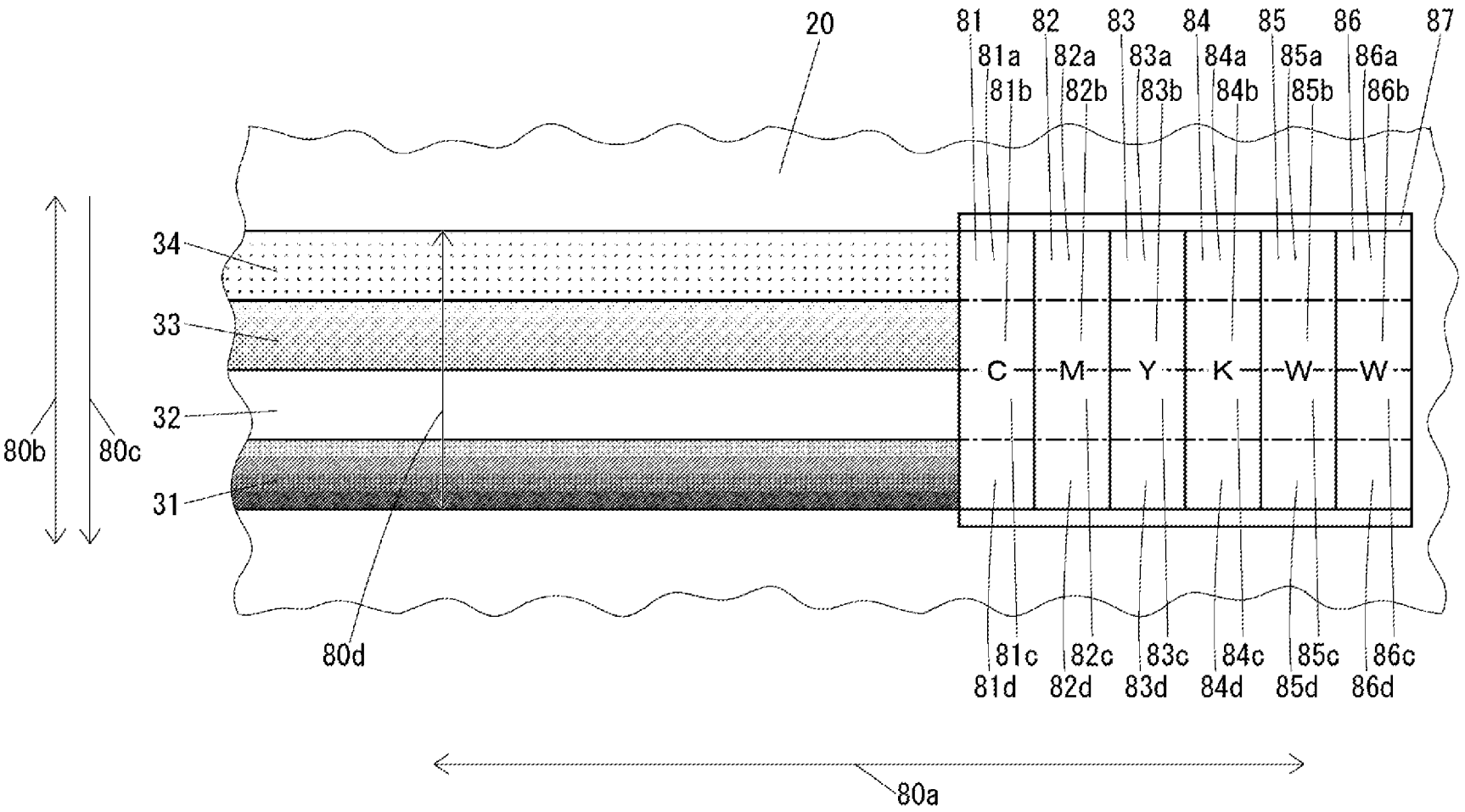
FIG. 13 is a drawing of a printing method for printing the front layer, white layer, black layer, and back layer using an inkjet printer illustrated in FIG. 7.

FIG. 13 is a drawing of a printing method for printing the front layer 31, white layer 32, black layer 33, and back layer 34 using an example of the inkjet printer 80.

The inkjet printer 80 illustrated in FIG. 13 has inkjet heads 81 to 86 configured to eject inks. The inkjet heads 81 to 86 are serial scan heads for inkjet printing. The colors of inks ejected from the inkjet heads 81 to 86 are respectively cyan, magenta, yellow, black, white, and white.

The front layer 31 and the back layer 34 are mostly printed with the inks ejected from the inkjet heads 81 to 84. The white layer 32 is printed with the inks ejected from the inkjet heads 85 and 86. The black layer 33 is printed with the ink ejected from the inkjet head 84.

The inkjet heads 81 to 86 are mounted in a carriage 87 and are moved relative to the medium 20 as the carriage 87 is moved relative to the medium 20.

The inkjet printer 80 illustrated in FIG. 13 ejects the inks to the medium 20 from the inkjet heads 81 to 86 during relative movement of the medium 20 or the group of inkjet heads 81 to 86 to the other in a main scanning direction indicated by arrow 80*a*.

For the ejection of the inks to the medium 20 from the inkjet heads 81 to 86 of the inkjet printer 80 illustrated in FIG. 13, a region targeted for ink ejection is divided into four quarters and further divided into the following regions per quarter, respectively for the inkjet heads 81 to 86, from an upstream side toward a downstream side in a direction of arrow 80*c* included in a sub scanning direction indicated by arrow 80*b* orthogonal to the main scanning direction; regions 81*a*, 82*a*, 83*a*, 84*a*, 85*a*, and 86*a* for printing the back layer 34, regions 81*b*, 82*b*, 83*b*, 84*b*, 85*b*, and 86*b* for printing the black layer 33, regions 81*c*, 82*c*, 83*c*, 84*c*, 85*c*, and 86*c* for printing the white layer 32, and regions 81*d*, 82*d*, 83*d*, 84*d*, 85*ad*, and 86*d* for printing the front layer 31.

Because the white layer 32 is printed with the inks ejected from the inkjet heads 85 and 86 as described earlier, the regions 81*c*, 82*c*, 83*c* and 84*c* are, in fact, left unused. Similarly, the regions 81*b*, 82*b*, 83*b*, 85*b*, and 86*b* are, in fact, left unused because the black layer 33 is printed with the ink ejected from the inkjet head 84.

The regions 81*d*, 82*d*, 83*d*, and 84*d* for the inkjet heads 81 to 84 are regions to be printed by a first head. The regions 85*c* and 86*c* for the inkjet heads 85 and 86 are regions to be printed by a second head. The region 84*b* for the inkjet head 84 is a region to be printed by a third head. The regions 81*a*, 82*a*, 83*a*, and 84*a* for the inkjet heads 81 to 84 are regions to be printed by a fourth head. The regions, 81*d*, 82*d*, 83*d*, and 84*d*, regions 85*c* and 86*c*, region 84*b*, and regions 81*a*,

82*a*, 83*a*, and 84*a* are arranged in this order in a direction opposite to the direction of arrow 80*c*, i.e., from the upstream side toward the downstream side in the certain direction.

The inkjet printer 80 of FIG. 13 produces the multilayered printed matter 10 illustrated in FIG. 5 by, for example, moving the medium 20 in the direction of arrow 80*c* relative to the inkjet heads 81 to 86 by a length corresponding to one-sixteenth of a length 80*d* of the ink-ejection region in the sub scanning direction upon completion of each printing cycle using the inkjet heads 81 to 86 in the main scanning direction.

In the inkjet printer 80 of FIG. 13 that moves the medium 20 relative to the inkjet heads 81 to 86 in the direction of arrow 80*c* by a length corresponding to one-sixteenth of the length 80*d* upon completion of each printing cycle using the inkjet heads 81 to 86 in the main scanning direction, optional portions of the front layer 31, white layer 32, black layer 33, and back layer 34 are respectively printed by the inkjet heads 81 to 86 in four printing cycles, i.e., in four passes, in the main scanning direction. In the multilayered printed matter 10, therefore, the inkjet printer 80 illustrated in FIG. 13 finishes the printing of optional portions of the respective layers in 16 passes. However, any number of passes but four passes may be set in the inkjet printer 80 of FIG. 13 to finish the printing of optional portions of the front layer 31, white layer 32, black layer 33, and back layer 34.

The inkjet printer 80 of FIG. 13 produces the multilayered printed matter 120 illustrated in FIG. 12 by, for example, moving the medium 20 in the direction opposite to the direction of arrow 80*c* relative to the inkjet heads 81 to 86 by a length corresponding to one-sixteenth of the length 80*d* upon completion of each printing cycle using the inkjet heads 81 to 86 in the main scanning direction.

Figure 14:
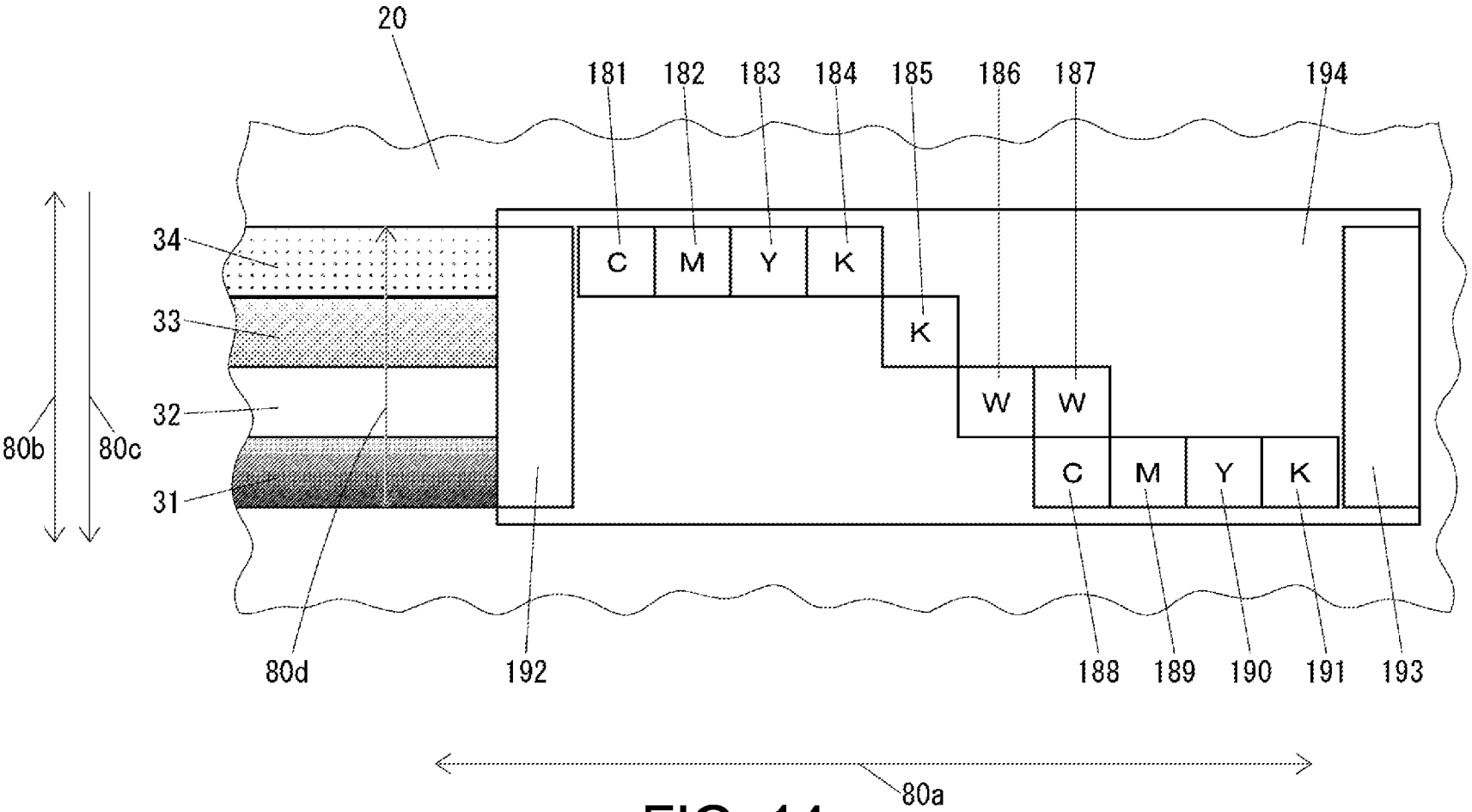
FIG. 14 is a drawing of another printing method, which is distinct from the printing method of FIG. 13, for printing the front layer, white layer, black layer, and back layer using the inkjet printer illustrated in FIG. 7.

FIG. 14 is a drawing of another printing method, which is distinct from the example of FIG. 13, for printing the front layer 31, white layer 32, black layer 33, and back layer 34 using an example of the inkjet printer 80.

The inkjet printer 80 illustrated in FIG. 14 has inkjet heads 181 to 191 configured to eject inks. The inkjet heads 181 to 191 are serial scan heads for inkjet printing. The colors of inks ejected from the inkjet heads 181 to 191 are respectively cyan, magenta, yellow, black, black, white, white, cyan, magenta, yellow, and black. The inks ejected from the inkjet heads 181 to 191 are UV inks curable by ultraviolet irradiation.

The inkjet printer 80 of FIG. 14 further has ultraviolet irradiators 192 and 193 that irradiate the inks ejected from the inkjet heads 181 to 191 with ultraviolet light. The ultraviolet irradiator 192 and 193 are disposed at two positions spaced apart across the inkjet heads 181 to 191 interposed therebetween in the main scanning direction of arrow 80*a*.

The back layer 34 is printed with the inks ejected from the inkjet heads 181 to 184. The black layer 33 is printed with the ink ejected from the inkjet head 185. The white layer 32 is printed with the inks ejected from the inkjet heads 186 and 187. The front layer 31 is printed with the inks ejected from the inkjet heads 188 to 191.

The inkjet heads 188 to 191 constitute the first head. The inkjet heads 186 and 187 constitute the second head. The inkjet head 185 constitutes the third head. The inkjet heads 181 to 184 constitute the fourth head. The inkjet heads 188 to 191, inkjet heads 186 and 187, inkjet head 185, and inkjet heads 181 to 184 are arranged in this order in the direction opposite to the direction of arrow 80*c*, i.e., from the upstream side toward the downstream side in the certain direction.

The inkjet heads 181 to 191 and the ultraviolet irradiators 192 and 193 are mounted in a carriage 194 and are moved relative to the medium 20 as the carriage 194 is moved relative to the medium 20.

The method for producing the multilayered printed matter 10, 120 using the inkjet printer 80 illustrated in FIG. 14 is essentially similar to the method for producing the multilayered printed matter 10, 120 using the inkjet printer 80 illustrated in FIG. 13. In the inkjet printer 80 of FIG. 14, the inks ejected from the inkjet heads 181 to 191 that just landed on the medium 20 are immediately irradiated to be cured with ultraviolet light emitted from one of the ultraviolet irradiators 192 and 193 on the upstream side in the direction of relative movement of the carriage 194 to the medium 20 in the main scanning direction.

Figure 15:
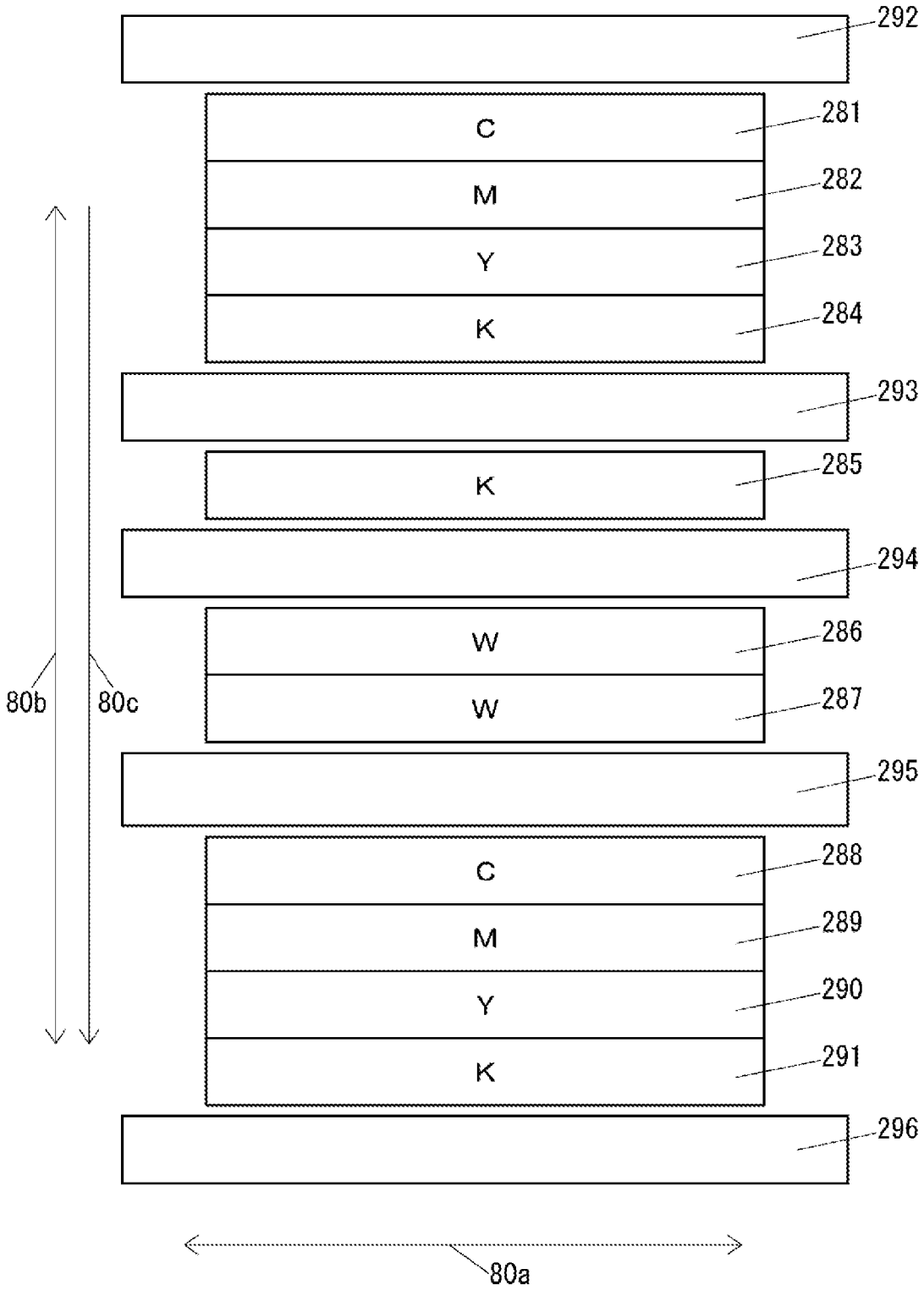
FIG. 15 is a drawing of yet another printing method, which is distinct from the printing methods of FIGS. 13 and 14, for printing the front layer, white layer, black layer, and back layer using the inkjet printer illustrated in FIG. 7.

FIG. 15 is a drawing of yet another printing method, which is distinct from the examples of FIGS. 13 and 14, for printing the front layer 31, white layer 32, black layer 33, and back layer 34 using an example of the inkjet printer 80.

The inkjet printer 80 illustrated in FIG. 15 has inkjet heads 281 to 291 configured to eject inks. The inkjet heads 281 to 291 are line scan heads for inkjet printing. The colors of inks ejected from the inkjet heads 281 to 291 are respectively cyan, magenta, yellow, black, black, white, white, cyan, magenta, yellow, and black. The inks ejected from the inkjet heads 281 to 291 are UV inks curable by ultraviolet irradiation.

The inkjet printer 80 of FIG. 15 further has ultraviolet irradiators 292 to 296 that irradiate the inks ejected from the inkjet heads 281 to 291 with ultraviolet light. The ultraviolet irradiators 292 and 293 are spaced apart in the direction of arrow 80*b* across the inkjet heads 281 to 284 interposed therebetween. The ultraviolet irradiators 293 and 294 are spaced apart in the direction of arrow 80*b* across the inkjet head 285 interposed therebetween. The ultraviolet irradiators 294 and 295 are spaced apart in the direction of arrow 80*b* across the inkjet heads 286 and 287 interposed therebetween. The ultraviolet irradiators 295 and 296 are spaced apart in the direction of arrow 80*b* across the inkjet heads 288 to 291 interposed therebetween.

The back layer 34 is printed with the inks ejected from the inkjet heads 281 to 284. The black layer 33 is printed with the ink ejected from the inkjet head 285. The white layer 32 is printed with the inks ejected from the inkjet heads 286 and 287. The front layer 31 is printed with the inks ejected from the inkjet heads 288 to 291.

The inkjet heads 288 to 291 constitute the first head. The inkjet heads 286 and 287 constitute the second head. The inkjet head 285 constitutes the third head. The inkjet heads 281 to 284 constitute the fourth head. The inkjet heads 288 to 291, inkjet heads 286 and 287, inkjet head 285, and inkjet heads 281 to 284 are arranged in this order in the direction opposite to the direction of arrow 80*c*, i.e., from the upstream side toward the downstream side in the certain direction.

Relative positions of the inkjet heads 281 to 291 and the ultraviolet irradiators 292 to 296 remain unchanged.

In the operation to produce the multilayered printed matter 10, the inkjet printer 80 illustrated in FIG. 15 ejects the inks to the medium 20 from the inkjet heads 281 to 291 during relative movement of the medium 20 to the inkjet heads 281 to 291 and the ultraviolet irradiators 292 to 296 in the direction of arrow 80*c*. In the operation to produce the multilayered printed matter 10, the inkjet printer 80 illustrated in FIG. 15 irradiates the inks ejected from the inkjet heads 281 to 284, inkjet head 285, inkjet heads 286 and 287, and inkjet heads 288 to 291 with ultraviolet light emitted from the ultraviolet irradiators 293, 294, 295, and 296 immediately after the inks landed on the medium 20.

In the operation to produce the multilayered printed matter 120, the inkjet printer 80 illustrated in FIG. 15 ejects the inks to the medium 20 from the inkjet heads 281 to 291 during relative movement of the medium 20 to the inkjet heads 281 to 291 and the ultraviolet irradiators 292 to 296 in the direction opposite to the direction of arrow 80*c*. In the operation to produce the multilayered printed matter 120, the inkjet printer 80 illustrated in FIG. 15 irradiates the inks ejected from the inkjet heads 281 to 284, inkjet head 285, inkjet heads 286 and 287, and inkjet heads 288 to 291 with ultraviolet light emitted from the ultraviolet irradiators 292, 293, 294, and 295 immediately after the inks landed on the medium 20.

The front layer 31, white layer 32, black layer 33, and back layer 34 may be printed by the inkjet printer 80 according to any suitable means but the examples illustrated in FIGS. 13 to 15.

Figure 16:
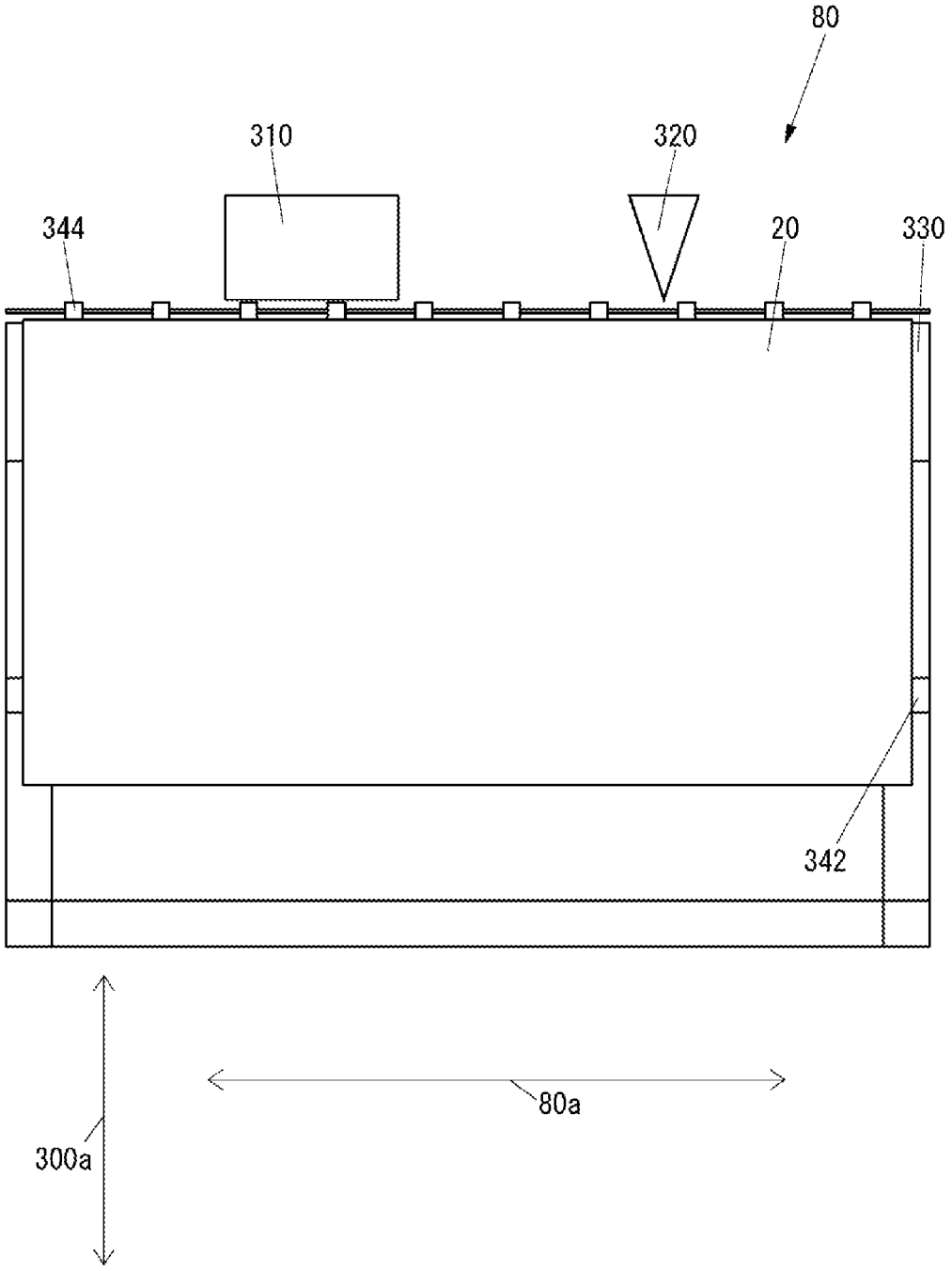
FIG. 16 is a schematic front view of the inkjet printer of FIG. 7 for serial head printing.
Figure 17:
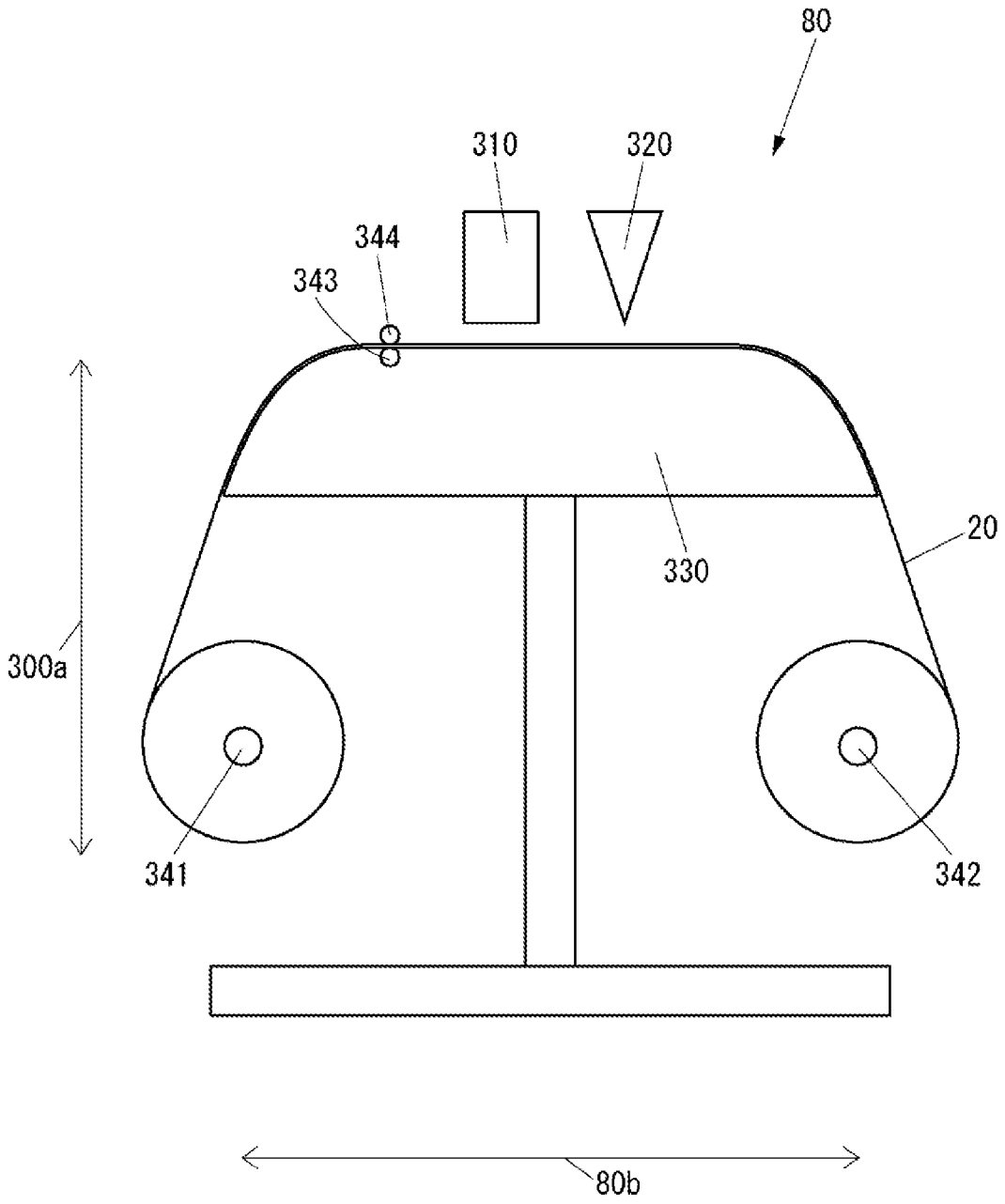
FIG. 17 is a schematic side view of the inkjet printer illustrated in FIG. 16.

FIG. 16 is a schematic front view of the inkjet printer 80 for serial head printing. FIG. 17 is a schematic side view of the inkjet printer 80 illustrated in FIG. 16.

As illustrated in FIGS. 16 and 17, the inkjet printer 80 includes an inkjet head 310, a cutting blade 320, a platen 330, a feeding roller 341, a take-up roller 342, a driving roller 343, and a driven roller 344. The cutting blade 320 is an example of the medium cutting device and is used to cut the medium 20. The platen 330 supports the medium 20 and is positioned so as to face the inkjet head 310 and the cutting blade 320. The feeding roller 341 is an example of the feeding part and supports the medium 20 wound in a roll before the layers are printed thereon by the inkjet head 310 so as to unwind and feed the medium 20. The take-up roller 342 is an example of the take-up part and rolls up and supports the medium 20 after the layers are printed thereon by the inkjet head 310. The driving roller 343 transports the medium 20, and the driven roller 344 presses the medium 20 against the driving roller 343.

The inkjet printer 80 is not equipped with a driving source for rotating the feeding roller 341. The inkjet printer 80, however, is equipped with a motor for the take-up roller as a driving source for rotating the take-up roller 342 (not illustrated in the drawings), and a slidable torque limiter (not illustrated in the drawings). The torque limiter prevents that the take-up roller 342 is subject to any torque greater than a certain magnitude generated by the motor for the take-up roller. The inkjet printer 80 is equipped with a motor for the driving roller as a driving source for rotating the driving roller 343 (not illustrated in the drawings). The inkjet printer 80 is not equipped with a driving source for rotating the driven roller 344.

When the driving roller 343 is in tight contact with the medium 20 without any slackness, the medium 20 wound around the feeding roller 341 is pulled by the driving roller 343, and the feeding roller 341 correspondingly rotates. As a result, the medium 20 is unwound and fed.

The driven roller 344 is rotated by the medium 20 in contact with the driven roller 344 being moved the driving roller 343.

The motor for the take-up roller constantly generates motive power solely in a direction of rotation in which the medium 20 is rolled up by the take-up roller 342. As said earlier, the torque limiter prevents that the take-up roller 342 is subject to any torque greater than a certain magnitude generated by the motor for the take-up roller. Therefore, the medium 20 between the driving roller 343 and the take-up roller 342 is constantly under a certain tension.

When the medium 20 is transported from the feeding roller 341 to the take-up roller 342 by the driving roller 343 being rotated by the motor for the driving roller, the medium 20 between the driving roller 343 and the take-up roller 342 is rolled up by the take-up roller 342 by a dimension corresponding to a distance of movement of the medium 20 by the driving roller 343.

When the medium 20 is transported from the take-up roller 342 to the feeding roller 341 by the driving roller 343 being rotated by the motor for the driving roller, the medium 20 wound around the take-up roller 342 is pulled by the driving roller 343, and the take-up roller 342 correspondingly rotates. As a result, the medium 20 is unwound and fed from the take-up roller 342. Between the feeding roller 341 and the driving roller 343, the medium 20 is not rolled up by the feeding roller 341 and may often become loose.

In FIGS. 16 and 17 illustrating no support mechanism for supporting the inkjet head 310 and the cutting blade 320, the inkjet head 310 and the cutting blade 320 appear as if they were suspended in the air. In practical use, the inkjet head 310 and the cutting blade 320 are supported by a support mechanism not illustrated in the drawings. The support mechanism movably supports the inkjet head 310 and the cutting blade 320 in a direction orthogonal to a vertical direction indicated by arrow 300*a*.

A lateral direction indicated by arrow 80*a* in FIG. 16 is a main scanning direction. A lateral direction indicated by arrow 80*b* in FIG. 17 is a sub scanning direction. The main scanning direction and the sub scanning direction are orthogonal to the vertical direction.

In the inkjet printer 80 illustrated in FIG. 13, the inkjet head 310 represents the inkjet heads 81 to 86. In the inkjet printer 80 illustrated in FIG. 14, the inkjet head 310 represents the inkjet heads 181 to 191.

The inkjet printers 80 illustrated in FIGS. 16 and 17 are both for serial head printing. The inkjet printer 80 may be a line head inkjet printer, as illustrated in FIG. 15.

Figure 18:
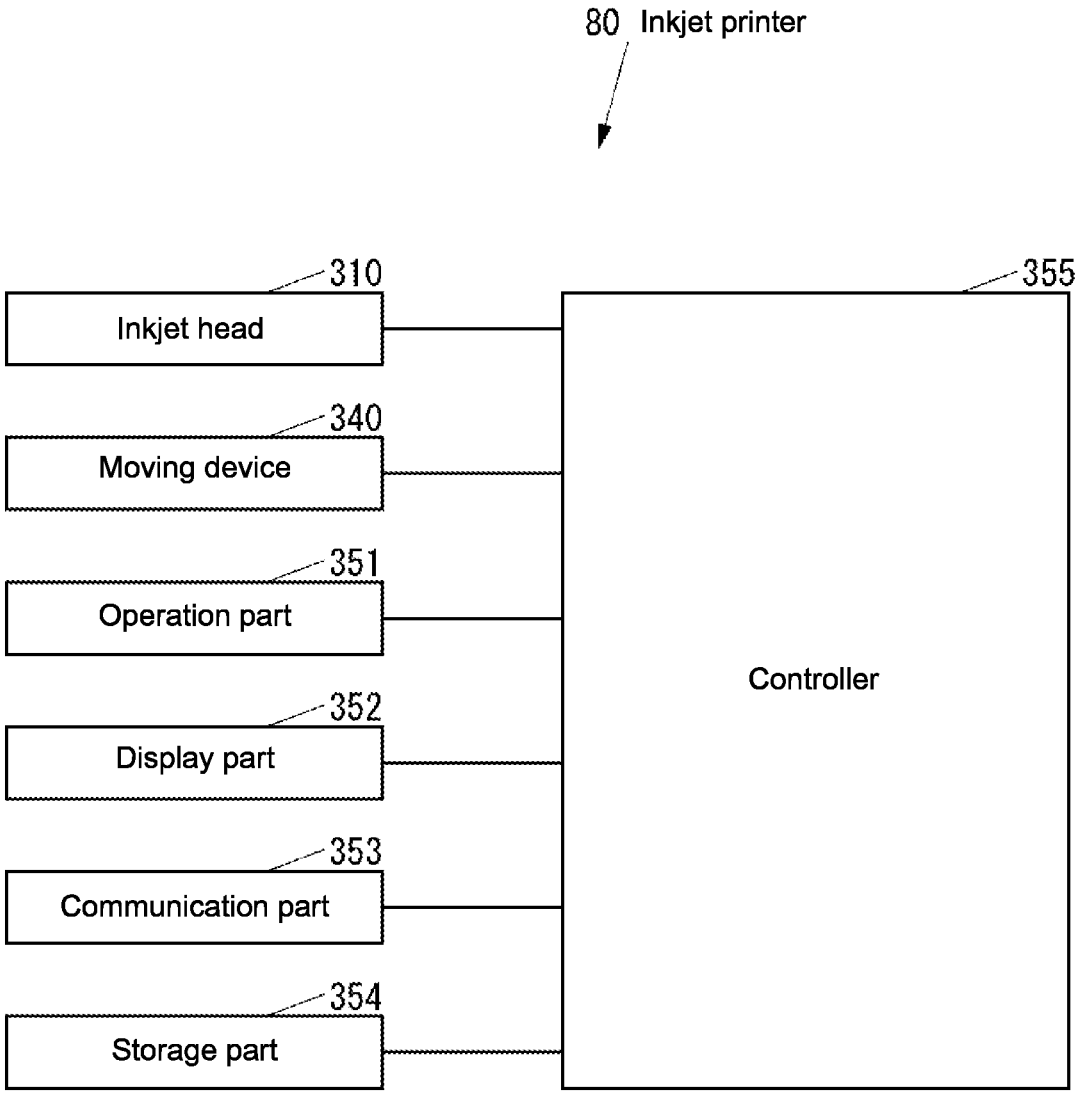
FIG. 18 is a block diagram of the inkjet printer illustrated in FIG. 16.

FIG. 18 is a block diagram of the inkjet printer 80.

Referring to FIG. 18, the inkjet head 80 includes an inkjet head 310, a moving device 340 that causes relative movement between the medium 20, and the inkjet head 310 and the cutting blade 320, an operation part 351 that is an input device, such as a button, used to input various instructions, a display part 352 that is a display device, such as an LCD for display of various pieces of information, a communication part 353 that is a communication device communicating with external devices through a network, or directly communicating with external devices wired or wirelessly not through the network, a storage part 354 that is a non-volatile storage device, such as a semiconductor memory or an HDD (Hard Disc Drive) storing various pieces of information, and a controller 355 that controls the whole inkjet printer 80.

The moving device 340 includes the feeding roller 341, take-up roller 342, driving roller 343, driven roller 344, motor for the take-up roller, torque limiter, motor for the driving roller, and support mechanism described earlier. The moving device 340 can move the medium 20 in the sub scanning direction relative to the inkjet head 310 and the cutting blade 320 by having the medium 20 fed from the feeding roller 341 and rolled up by the take-up roller 342 or by having the medium 20 fed from the take-up roller 342 and rolled up by the feeding roller 341. The moving device 340 moves the inkjet head 310 and the cutting blade 320 supported by the support mechanism in the main scanning direction, and can thereby move the inkjet head 310 and the cutting blade 320 relative to the medium 20 in the main scanning direction. The moving device 340 may be further configured to move the cutting blade 320 supported by the support mechanism in the sub scanning direction.

The controller 355 includes a CPU, a ROM in which programs and various pieces of data are stored, and a RAM serving as a working region for the CPU. The CPU is configured to run the programs stored in the ROM or the storage part 354.

Figure 19:
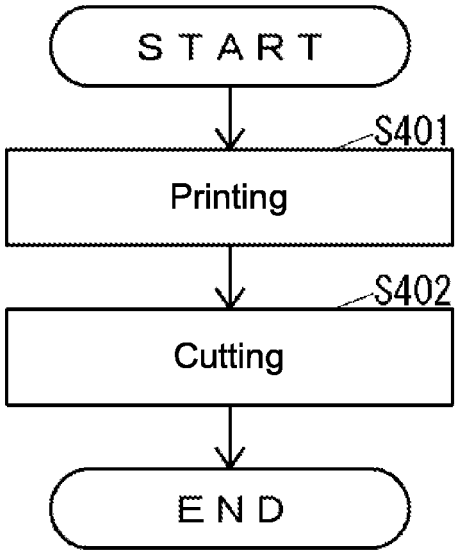
FIG. 19 is a flowchart of steps in the operation of the production system illustrated in FIG. 7.

FIG. 19 is a flowchart of steps in the operation of the production system 70.

As illustrated in FIG. 19, the computer 90 transmits printing data to the inkjet printer 80 to execute a printing step (S401). In this printing step, the medium 20 and the inkjet head 310 are moved relative to each other by the moving device 340, so that the front layer 31, white layer 32, black layer 33, and back layer 34 are printed on the medium 20 by the inkjet head 310. In the inkjet printer 80, during the printing operation using the inkjet head 310, the cutting blade 320 stays at an edge position in the main scanning direction, i.e., a position outside a printable region of the inkjet head 310.

Subsequent to the printing step in S401, the computer 90 transmits cutting data to the inkjet printer 80 in the same manner as the printing data to carry out a cutting step (S402). In this cutting step, the medium 20 and the cutting blade 320 are moved relative to each other by the moving device 340, so that the medium 20 is cut by the use of the cutting edge 320. In the inkjet printer 80, during the cutting operation using the cutting blade 320, the inkjet head 310 stays at an edge position in the main scanning direction, i.e., a position outside a cuttable region of the cutting blade 320.

Thus, the computer 90 constitutes the printing and cutting controller that controls the printing and cutting operations using the inkjet head 310 and the cutting blade 320.

Next, a test for the printing step and the cutting step in the inkjet printer 80 (hereinafter, printing and cutting test) is hereinafter described. The printing and cutting test constitutes the test cutting step for deciding a depth of insertion of the cutting blade 320 into the medium 20 prior to the cutting step.

The operator can input an instruction to start the printing and cutting test to the inkjet printer 80 using the operation part 351. In response to the instruction to execute the printing and cutting test, the controller 355 of the inkjet printer 80 carries out steps illustrated in FIG. 20.

Figure 20:
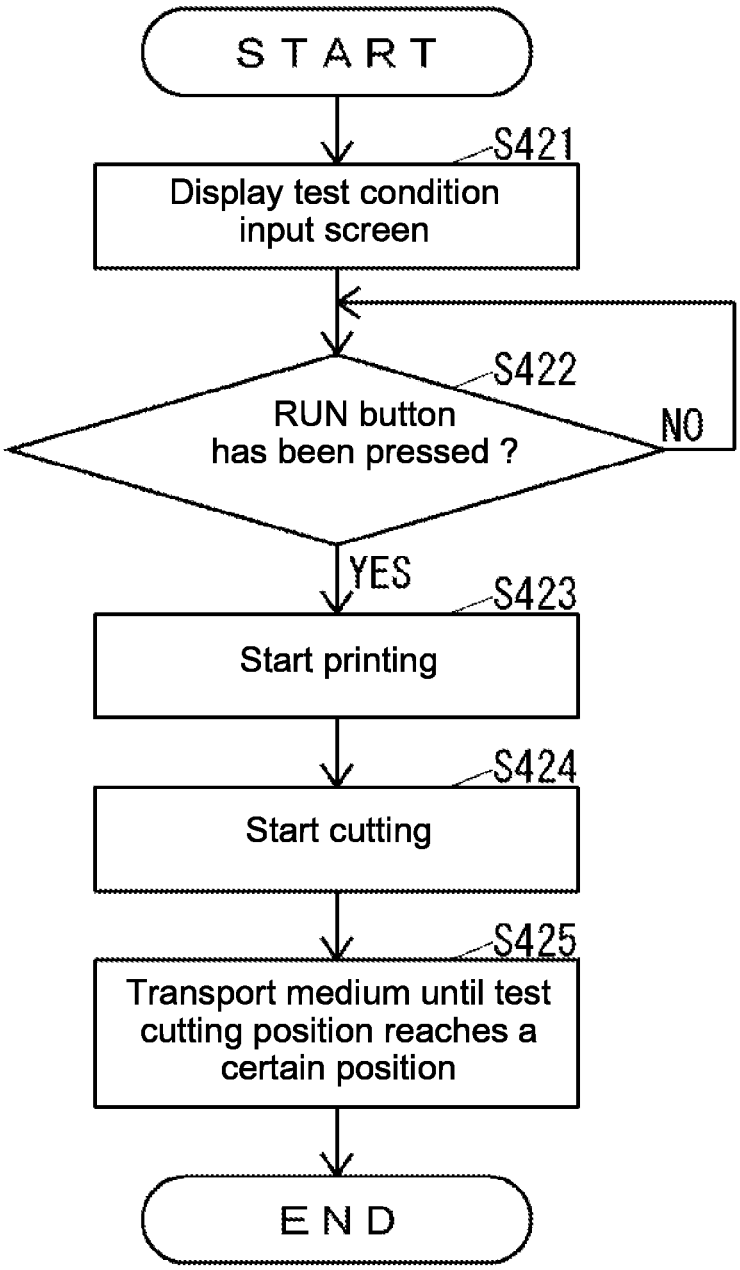
FIG. 20 is a flowchart of steps in the operation of the inkjet printer illustrated in FIG. 16 when a printing and cutting test is carried out.

FIG. 20 is a flowchart of steps in the operation of the inkjet printer 80 when the printing and cutting test is carried out.

As illustrated in FIG. 20, the controller 355 displays on the display part 352 a test condition input screen 440 (see FIG. 21) to input conditions to be set for the printing and cutting test (S421).

Figure 21:
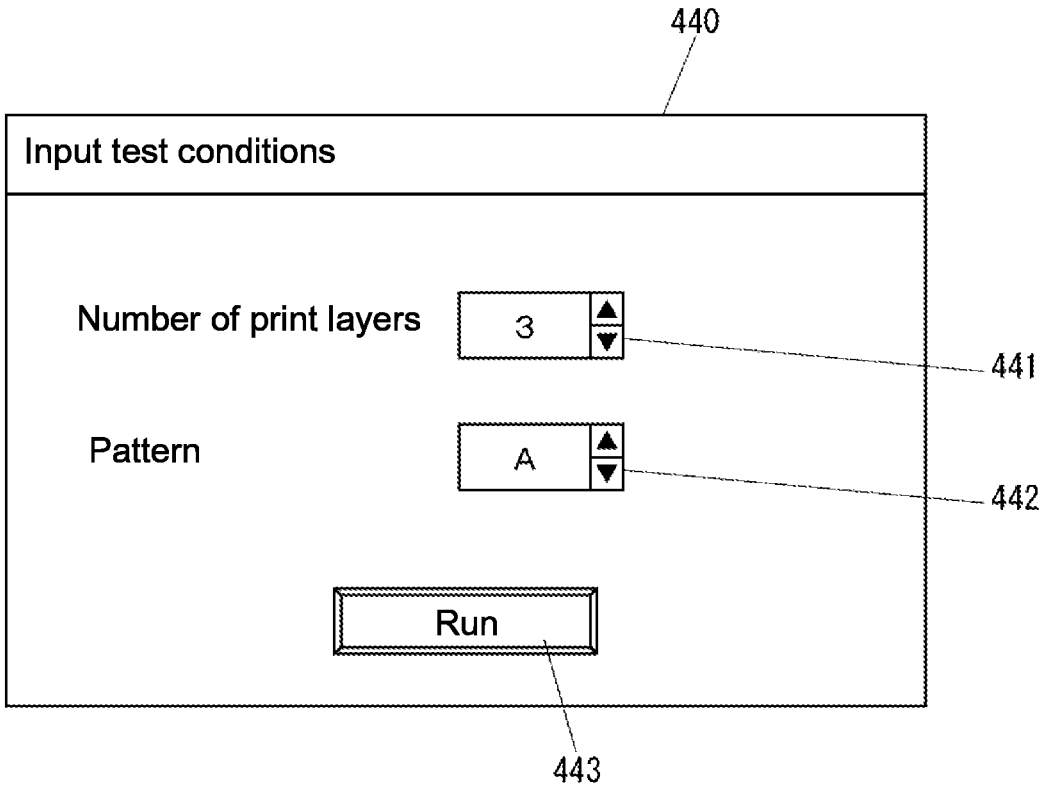
FIG. 21 is a drawing of a test condition input screen displayed in the operation of FIG. 20.

FIG. 21 is a drawing of an example of the test condition input screen 440.

As illustrated in FIG. 21, the test condition input screen 440 includes a layer number input section 441, a pattern input section 442, and a RUN button 443. Of the conditions to be set for the printing and cutting test, the layer number input section 441 is used to input the number of layers to be printed in multilayer printing, and the pattern input section 442 is used to input patterns to be printed and cut. The RUN button 443 is used to start the printing step and the cutting step.

The printing data and the cutting data used in the printing and cutting test are prepared beforehand. Different pieces of printing data and cutting data associated with patterns acceptable via the pattern input section 442 are separately prestored per pattern in the storage part 354. Cutting positions specified in the cutting data correspond to positions within an image to be printed based on the printing data.

The patterns acceptable via the pattern input section 442 include a group of print layers including two pattern layers with patterns printed thereon, and at least one concealment layer disposed between the pattern layers so as to conceal one of the pattern layers to be invisible from the side of the other pattern layer.

As illustrated in FIG. 20, the controller 355, subsequent to S421, continues to determine whether the RUN button 443 is pressed until the RUN button 443 being pressed is confirmed (S422).

When it is determined in S422 that the RUN button 443 was pressed, the controller 355 executes the printing step in which the layers are printed on the medium 20 by the use of the inkjet head 310 and the moving device 340 based on the printing data appropriate for the patterns accepted via the pattern input section 442 and the number of layers accepted via the layer number input section 441 (S423).

Next, the controller 355 executes the cutting step in which the medium 20 is cut by the use of the cutting blade 320 and the moving device 340 based on the cutting data appropriate for the patterns accepted via the pattern input section 442 (S424).

Next, the controller 355 prompts the moving device 340 to transport the medium 20 until a printing position in S423 and a cutting position in S424 (hereinafter, referred to as "test cutting position") coincide with certain positions to allow the operator to easily check these printing and cutting positions (S425), and then ends the operation illustrated in FIG. 20.

In the operation illustrated in FIG. 20, the controller 355 prompts the moving device 340 to automatically transport the medium 20 in S425 until the test cutting position coincides with a certain position. The controller 355 may not necessarily be configured to prompt the moving device 340 to automatically transport the medium 20 until the test cutting position coincides with a certain position. For example, the controller 355 may prompt the moving device 340 to move the medium 20 until the test cutting position coincides with a certain position in response to a certain instruction inputted via the operation part 351.

In the operation illustrated in FIG. 20, after the medium 20 is moved by the moving device 340 until the test cutting position coincides with a certain position, the controller 355 may prompt the moving device 340 to move the medium 20 back to its original position in response to a certain instruction inputted via the operation part 351.

In the operation involving the printing and cutting test, the controller 355 thus constitutes the printing and cutting controller that controls the printing and cutting operations using the inkjet head 310 and the cutting blade 320.

In case the test cutting position is at a certain position subsequent to the cutting in S424, the operator may check the printing position at which the printing was performed in S423 so as to determine various pieces of printing-related information from a printing outcome such as nozzle condition in the inkjet head 310. Then, the operator may adjust the inkjet printer 80 based on the obtained result.

The operator checks the cutting position at which the cutting was performed in S424 to determine various pieces of cutting-related information from a cutting outcome. Then, the operator may adjust the inkjet printer 80 based on the obtained result. The operator, if the insertion of the cutting blade into any multilayer-printed part of the medium 20 is found to be too deep or too shallow or any cutting-induced crack is detected in the group of print layers, may adjust the amount of blade projection of the cutting blade 320 and at least one of a cutting pressure and a cutting speed in the inkjet printer 80.

Figure 22A:
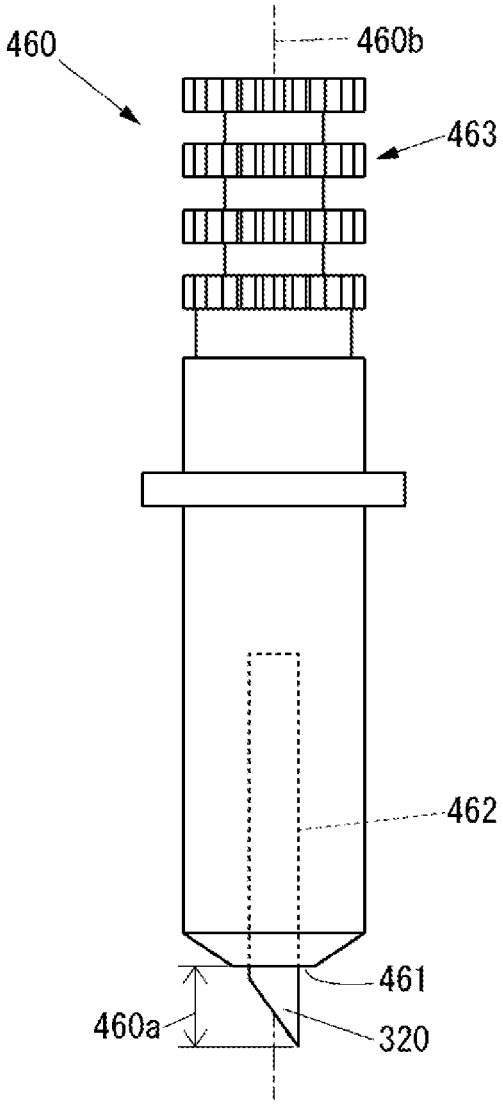
FIG. 22A is a front view of a holder that holds a cutting blade illustrated in FIG. 16.
Figure 22B:
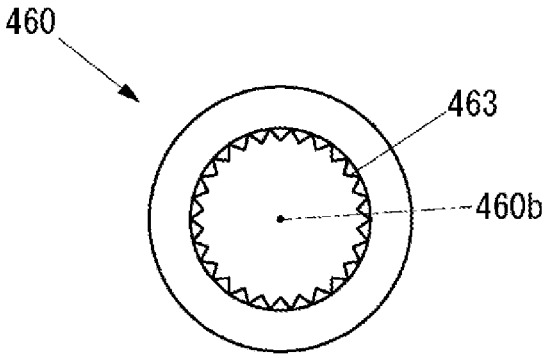
FIG. 22B is an upper view of the holder illustrated in FIG. 22A.

FIG. 22A is a front view of a holder 460 that holds the cutting blade 320. FIG. 22B is an upper view of the holder 460.

As illustrated in FIG. 22, the holder 460 has an object contact surface 461 to make contact with an object being cut with the cutting blade 320, and a hole 462 formed in the object contact surface 461 for the cutting blade 320 to be inserted therein. The holder 460 has an adjustment knob 463 used to change an amount of blade projection 460*a* which is a length between an edge of the cutting blade 320 inserted in the hole 462 and the object contact surface 461. The amount of blade projection 460*a* changes with rotation of the adjustment knob 463 of the holder 460 around a center axis 460*b*.

Figure 23A:
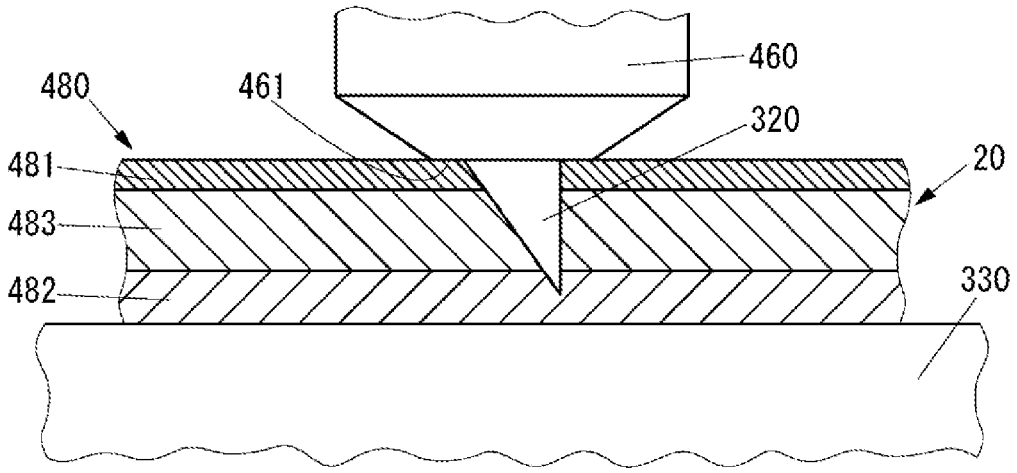
FIG. 23A is a front cross-sectional view of the multilayered printed matter being cut by using the cutting blade of FIG. 22 with a right amount of blade projection.
Figure 23B:
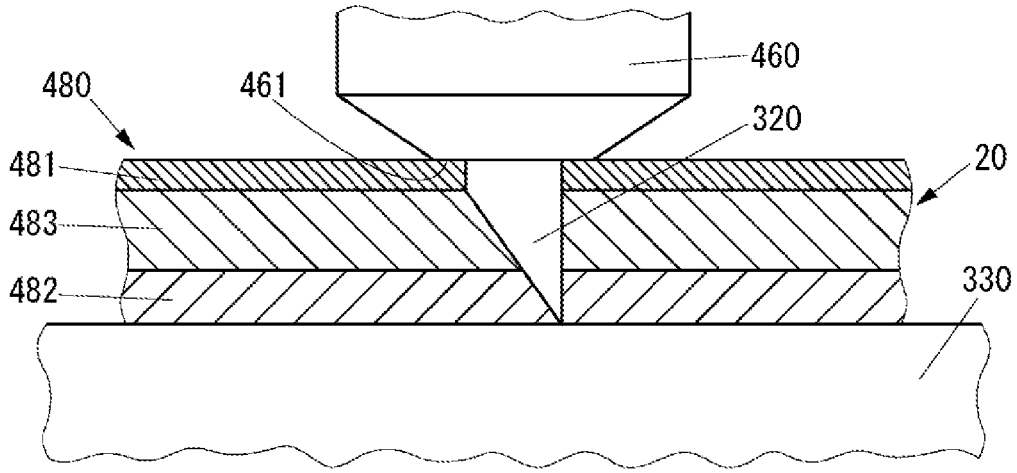
FIG. 23B is a front cross-sectional view of the multilayered printed matter being cut by using the cutting blade of FIG. 22 with an excess amount of blade projection.
Figure 23C:
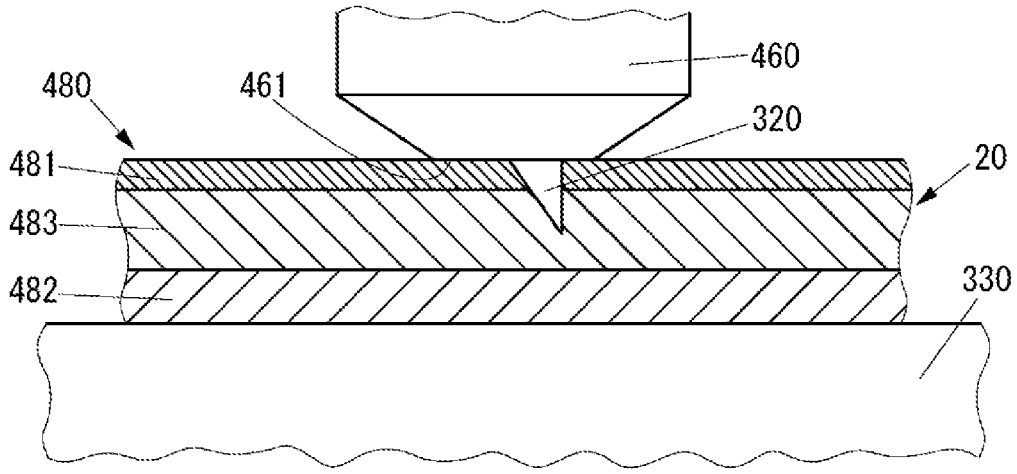
FIG. 23C is a front cross-sectional view of the multilayered printed matter being cut by using the cutting blade of FIG. 22 with an inadequate amount of blade projection.

FIG. 23A is a front cross-sectional view of a multilayered printed matter 480 being cut by the use of the cutting blade 320 with a right amount of blade projection 460*a*. FIG. 23B is a front cross-sectional view of the multilayered printed matter 480 being cut by the use of the cutting blade 320 with an excess amount of blade projection 460*a*. FIG. 23C is a front cross-sectional view of the multilayered printed matter 480 being cut by the use of the cutting blade 320 with an inadequate amount of blade projection 460*a*.

As illustrated in FIG. 23, the multilayered printed matter 480 includes a medium 20, and a group of print layers 481 formed on the medium 20. The medium 20 includes a board 482 and a seal 483 adhered to the board 482. The group of print layers 481 are formed on the seal 483. The group of print layers 30 in a portion of the multilayered printed matter 10 or 120 to be cut in the cutting step are formed on the medium 20 in a simulated manner, which constitute the group of print layers 481. The group of print layers 481 are equal in thickness to the group of print layers 30.

The operator, when checking any portion of the multilayered printed matter 480 cut in S424, determines whether the multilayered printed matter 480 was thoroughly cut in its thickness direction. When the operator determines that the multilayered printed matter 480 was thoroughly cut in its thickness direction, the amount of blade projection 460*a* may be found to be excess, as illustrated in FIG. 23B.

The operator, when checking any portion of the multilayered printed matter 480 cut in S424, determines whether the seal 483 was thoroughly cut in its thickness direction after removal of the seal 483 from the board 482. When the operator determines that the seal 483 was not thoroughly cut in its thickness direction, the amount of blade projection 460*a* may be found to be inadequate, as illustrated in FIG. 23C.

When the operator determines that the multilayered printed matter 480 was not thoroughly cut in its thickness direction but the seal 483 was thoroughly cut in its thickness direction, the amount of blade projection 460*a* may be found to be right, as illustrated in FIG. 23A.

The multilayered printed matter 480 made up of the group of print layers 481 increased in thickness may more greatly affect the cutting operation than regular printed matters consisting of one print layer, and may require adjustment of the amount of blade projection 460*a*. In order to adjust the amount of blade projection 460*a*, it may be necessary to know how the thickness of the group of print layers 481 affects the cutting operation in the multilayered printed matter 480. In the inkjet printer 80, the group of print layers 481 equal in thickness to the group of print layers 30 in a portion of the multilayered printed matter 10 or 120 to be cut in the cutting step are printed on the medium 20 by the use of the inkjet head 310, and then, the printing and cutting test is carried out in which the cutting blade 320 is entered into the medium 20 through the group of print layers 481 so as to cut the medium 20 (S423 and S424). Thus, how the thickness of the group of print layers 481 in the multilayered printed matter 480 affects the cutting operation may be easily known.

The printing and cutting test is feasible insofar as the multilayered printed matter 10 or 120 is thick enough in any portion to be cut. The printing data used in the printing and cutting test may not need to be prepared beforehand. For example, the controller 355 of the inkjet printer 80 may generate pseudo data of the pattern layers or the concealment layer on the spot based on solid print patterns designated by the operator when the printing and cutting test is to be carried out. The cutting data used in the printing and cutting test may not need to be prepared beforehand, like the printing data.

The controller 355 of the inkjet printer 80 starts the printing and cutting test described so far as instructed by the operator. The controller 355 may automatically start the printing and cutting test without any instruction from the operator.

The controller 355 of the inkjet printer 80 executes, as the test cutting step, the printing and cutting test in which printing and cutting are both involved. The controller 355 may execute the test cutting step for cutting alone. In this instance, the operator may prompt the inkjet printer 80 to print the group of print layers to be cut in the test cutting step prior to the test cutting step. Then, in the test cutting step, the controller 355 may prompt the cutting blade 320 to cut a portion of the medium 20 where the group of print layers are formed.

The portion cut in the test cutting step is a portion where the pattern layers and the concealment layer are both formed. The portion cut in the test cutting step may be a portion where the pattern layers alone or the concealment layer alone is formed.

In case the inkjet printer 80 is equipped with a device that ejects any material but ink onto the print layers such as a dispenser, the controller 355, in the printing and cutting test of FIG. 20, may eject the material from such a device between S423 and S424. An example of the material ejected from the device may be an uncured, high-viscosity transparent material that is curable under certain conditions.

As described thus far, the production system 70 includes the inkjet printer 80 equipped with the inkjet head 310 that prints the layers on the medium 20 and the cutting blade 320 used to cut the medium 20. Once the medium 20 is set in the inkjet printer 80, the printing step (S401) is performed in which the medium 20 and the inkjet head 310 are moved relative to each other by the moving device 340 of the inkjet printer 80, and the cutting step (S402) is then performed in which the medium 20 and the cutting blade 320 are moved relative to each other by the moving device 340 of the inkjet printer 80 used to print the layers on the medium 20. The production system 70, therefore, makes it unnecessary for the operator to manually move the medium 20 printed in the printing step for the subsequent cutting step. This may reduce the operator's workload in producing the multilayered printed matter 10, 120, as compared with the known art in which the operator has to manually relocate the medium 20 from a device exclusive for printing use to a cutting device.

In the production system 70, the inkjet printer 80 is equipped with the feeding roller 341 and the take-up roller 342, as illustrated in FIGS. 16 and 17 to print the layers on, for example, the medium 20 wound in a roll. However, the printing step may take unusually long time in case such a long medium 20 is the printing target. In the production system 70, the layers of the multilayered printed matter 10, 120 may be printed in a plurality of passes, in which case the printing step may require more time with an increasing number of passes. In the production system 70, therefore, the printing step may need more time with an increasing number of print layers to be printed to produce the multilayered printed matter 10, 120. The production system 70 may greatly contribute to reduction of the operator's workload in producing the multilayered printed matter 10, 120 particularly in the case of a time-consuming printing step involving use of long media and/or a large number of print layers.

In the production system 70, the computer 90 prompts the driving roller 343 to return the medium 20 wound around the take-up roller 342 in the printing step to the feeding roller 341 in the cutting step. The medium 20 may be cut in the cutting step when the medium 20 on the take-up roller 342 is returned to the feeding roller 341 by the driving roller 343, or when the medium 20, which has been returned from the take-up roller 342 to the feeding roller 341 by the driving roller 343, is transported again by the driving roller 343 from the feeding roller 341 to the take-up roller 342.

The computer 90 may reduce the length in the sub scanning direction of a region printed on the medium 20 in one printing step to less than a certain length. In case the computer 90 is configured to reduce the length in the sub scanning direction of a region printed on the medium 20 in one printing step to less than a certain length but an image to be printed on the medium 20 has a length in the sub scanning direction greater than or equal to the certain length, the image may be divided into a plurality of regions each having a length in the sub scanning direction less than the certain length, and the printing step and the cutting step may be repeatedly carried out for each one of the regions.

The inkjet printer 80 may arrange a cutting original position in the cutting step and a printing original position in the printing step to coincide with each other. This may improve the accuracy of cutting the printed patterns.

The multilayered printed matter 10, 120 is provided with the white layer 32 and the black layer 33, which are the concealment layers, between the front layer 31 and the back layer 34. Therefore, the back layer 34 may be better concealed in the multilayered printed matter being observed by the user 60 from the opposite side of the back layer 34 across the front layer 31, i.e., from the opposite side of the light source 50, under light coming from the side of the front layer 31, with no light from the light source 50 disposed on the opposite side of the front layer 31 across the back layer 34. In the multilayered printed matter 10, 120, among a plurality of patterns, a pattern closer to the light source 50 may be better concealed to be invisible from the front-surface side in the absence of light from the light source 50 on the back-surface side.

In the multilayered printed matter 10, 120, the black layer 33 exerts a higher light blocking effect than the white layer 32 in comparison between the black layer 33 and the white layer 32 that are equal in thickness. The combination of two concealment layers; white and black layers 32 and 33, thinner than one white layer 32, may accordingly offer comparable concealability. Therefore, the whole concealment layers may be favorably decreased in thickness in the multilayered printed matter 10, 120. In the multilayered printed matter 10, 120 under light emitted from the light source 50 disposed on the opposite side of the front layer 31 across the back layer 34, with light coming from the side of the front layer 31 being substantially blocked, light emitted from the light source 50 and transmitting through these concealment layers may be scattered by the concealment layers. In the multilayered printed matter 10, 120 configured as described above, however, the amount of scattering light may be reduced, and light emitted from the light source 50 may consequently allow the back layer 34 to be clearly visible from the side of the front layer 31. In the multilayered printed matter 10, 120 under light emitted from the light source 50 disposed on the opposite side of the front layer 31 across the back layer 34, with light coming from the side of the front layer 31 being substantially blocked, for example, light from the light source 50 may allow the pattern contour on the back layer 34 to be clearly visible from the side of the front layer 31.

The multilayered printed matter 10, 120 is provided with two concealment layers; black layer 33 and white layer 32, made of the inks having different light blocking effects, and the white layer 32 made of the white ink has an inferior light blocking effect to the black layer 33. Therefore, the combination of two concealment layers thinner than one concealment layer made of the white ink may accordingly offer comparable concealability. The multilayered printed matter 10, 120 in which the concealment layers combined are thus reduced in thickness may decrease ink consumption for the concealment layers. The multilayered printed matter 10, 120 in which the concealment layers combined are reduced in thickness may shorten time required to print the concealment layers in case the concealment layers are printed as, for example, described below. In a printing method using an inkjet printer in which positions of the inkjet heads 81 to 86 relative to the medium 20 are identical in the sub scanning direction, for example, the inks to be ejected to the medium 20 from the inkjet heads 81 to 86 may be increased by increasing the number of passes, i.e., the number of relative movements of the inkjet heads 81 to 86 to the medium 20 in the main scanning direction. In such a method, time required to print the concealment layers may be shortened by forming the whole concealment layers in a smaller thickness, i.e., by decreasing the inks to be ejected to the medium 20 from the inkjet heads 81 to 86 to form these layers.

If the light blocking effect of the concealment layer on the side of the back layer 34 is too low in the multilayered printed matter 10, 120, the user 60 may readily see the pattern on the back layer 34 when the printed matter is under light coming from the side of the user 60, i.e., ambient light. If the light blocking effect of the concealment layer on the side of the back layer 34 is too high in the multilayered printed matter 10, 120, the user 60 situated on the opposite side of the light source 50 may fail to see the pattern on the back layer 34 even when the printed matter is under light emitted from the light source 50. In the multilayered printed matter 10, 120, therefore, the blackness of the concealment layer on the side of the back layer 34 may desirably be neither too high nor too low. When, for example, the thinner medium 20 is used in the multilayered printed matter 10, 120, light from the light source 50 is more likely to transmit through the medium 20. In that case, the blackness of the concealment layer on the side of the back layer 34 may desirably be higher. In the multilayered printed matter 10, 120, the user 60 may be more likely to see the pattern on the back layer 34 when light from the side of the user 60, i.e., ambient light, is more intense. In that case, the blackness of the concealment layer on the side of the back layer 34 may desirably be higher.

In the multilayered printed matter 10, 120 under light emitted from the light source 50 on the side of the back layer 34, with light coming from the side of the front layer 31 being substantially blocked, light emitted from the light source 50 is likely to transmit through a region 10*b* where the black layer 33 is unformed for the front layer 31 in the layer-stacking direction (see FIG. 6). This may allow for a highlighted display of the region 10*b* where the black layer 33 is unformed for the front layer 31 in the layer-stacking direction when the multilayered printed matter 10, 120 is observed by the user 60 from the opposite side of the light source 50 under light emitted from the light source 50 on the side of the back layer 34, with light coming from the side of the front layer 31 being substantially blocked.

In the multilayered printed matter 10, 120 according to this embodiment, the black layer 33 includes a portion 33*a* where the black layer 33 is unformed for the front layer 31 in the layer-stacking direction. In the multilayered printed matter 10, 120, the white layer 32 may include a portion where the white layer 32 is unformed for the front layer 31 in the layer-stacking direction.

In the multilayered printed matter 10, 120, the concealment layer on the side of the back layer 34 is the black layer 33 that exerts a high light blocking effect, which suggests that an adequate light blocking effect may be attainable with the concealment layer on the side of the back layer 34 reduced in thickness. In the multilayered printed matter 10, 120, the concealment layer on the side of the back layer 34 may not necessarily be a black layer.

In the multilayered printed matter 10, 120, the concealment layer on the side of the front layer 31 is the white layer 32 having a high degree of lightness. When the front layer 31 is observed by the user 60 from the opposite side of the light source 50 under light coming from the side of the front layer 31, with no light from the light source 50 disposed on the side of the back layer 34, the pattern presented by the front layer 31 may be improved in lightness by the concealment layer on the side of the front layer 31 that excels in lightness. In the multilayered printed matter 10, 120, the concealment layer on the side of the front layer 31 may not necessarily be a white layer.

In the multilayered printed matter 10, 120, the material of the concealment layer on the side of the back layer 34 has a higher light blocking effect than the material of the concealment layer on the side of the front layer 31. The concealment layer on the side of the front layer 31 may accordingly have a higher degree of lightness than the concealment layer on the side of the back layer 34. In the multilayered printed matter 10, 120, the concealment layer on the side of the front layer 31, i.e., white layer 32, has a higher degree of lightness than the concealment layer on the side of the back layer 34, i.e., black layer 33. When the front layer 31 is observed by the user 60 from the opposite side of the light source 50 under light coming from the side of the front layer 31, with no light from the light source 50 disposed on the side of the back layer 34, the pattern presented by the front layer 31 may be improved in lightness by the white layer 32 that excels in lightness.

In the multilayered printed matter 10, 120, the concealment layer on the side of the back layer 34 has a higher light blocking effect and lower light reflectivity than the concealment layer on the side of the front layer 31 in comparison between these layers that are equal in thickness. Such distinctiveness in terms of the light blocking effect and light reflectivity may result from different materials used or from structural differences in case the same material is used. The structural differences may include different particle sizes in the inks used or different ratios of particles included in the inks used.

The examples of the multilayer printing method illustrated in FIGS. 13 to 15 may successfully print at once all of the four layers; front layer 31, white layer 32, black layer 33, and back layer 34, by just moving the medium 20 relative to the inkjet heads 81 to 86, 181 to 191, 281 to 291 in one of the directions included in the sub scanning direction indicated by arrow 80*b*. This may achieve an improved accuracy in positioning the print layers relative to one another, as compared with any methods in which the print layers are formed one by one in their entirety. As a result, the multilayered printed matter 10, 120 thereby obtained may improve in quality.

In the inkjet printer 80 of this embodiment, the medium 20 returned from the take-up roller 342 to the feeding roller 341 by the driving roller 343 is not rolled up by the feeding roller 341. In the inkjet printer 80 equipped with a motor as a driving source for rotating the feeding roller 341, the medium 20 returned from the take-up roller 342 to the feeding roller 341 by the driving roller 343 may be wound around and collected by the feeding roller 341.

In the inkjet printer 80 of this embodiment, the roll-to-roll process is employed, as illustrated in FIGS. 16 and 17. The inkjet printer 80, however, may employ any other suitable technique but the roll-to-roll process, which is, for example, the flat-bed process in which the inkjet head 310 and the cutting blade 320 are moved instead of the medium 20 on a flat platen.

In the inkjet printer 80 of this embodiment, the cutting blade 320 is used as an example of the medium cutting device disclosed herein. The medium cutting device disclosed herein may be selected from any other suitable means but the cutting blade, for example, means for cutting the medium 20 using laser.

In the production system 70 of this embodiment, the computer 90 constitutes the printing and cutting controller; however, any other suitable means may constitute the printing and cutting controller. In the production system 70, the controller 355 of the inkjet printer 80 and the computer 90 collaborating with each other may constitute the printing and cutting controller, or the controller 355 alone may constitute the printing and cutting controller. In case the controller 355 alone constitutes the printing and cutting controller, the inkjet printer 80 independently constitutes the system for producing multilayered printed matter disclosed herein.

The multilayered printed matter 10, 120 of this embodiment includes two concealment layers; white layer 32 and black layer 33. The multilayered printed matter 10, 120 may include any optional number of concealment layers but two concealment layers. Specifically, the multilayered printed matter 10, 120 may include one concealment layer or three or more concealment layers.

What is claimed is:

1. A system for producing a multilayered printed matter for use in printing a multilayered printed matter in which layers are formed on a medium, the layers comprising:

two pattern layers with patterns formed thereon; and a concealment layer, the concealment layer being interposed between the two patternlayers so as to conceal one of the two pattern layers to be invisible from a side of the other one of the two pattern layers, the system comprising:

an inkjet head that ejects ink to the medium to print the layers on the medium;

a medium cutting device that cuts the medium;

a moving device that causes relative movement between the medium, and the inkjet head and the medium cutting device; and a printing and cutting controller that controls operations to print the layers on the medium using the inkjet head and to cut the medium using the medium cutting device, the printing and cutting controller executing:

a printing step of moving the medium and the inkjet head relative to each other using the moving device and printing the two pattern layers and the concealment layer on the medium using the inkjet head, a cutting step, subsequent to the printing step, of moving the medium and the medium cutting device relative to each other using the moving device and cutting the medium using the medium cutting device, wherein the medium cutting device comprises a cutting blade used to cut the medium, a test printing step of printing, on the medium using the inkjet head, a group of print layers equal in thickness to an optional group of print layers in a portion of the multilayered printed matter to be cut in the cutting step, a test cutting step of inserting the cutting blade into the medium on which the test print is performed so as to cut the medium, and a blade projection adjusting step for adjusting blade projection of the cutting blade based on the result of the test cut step.

2. The system for producing the multilayered printed matter according to claim 1, wherein the moving device comprises:

a feeding part that supports the medium wound in a roll before the layers are printed on the medium by the inkjet head so as to unwind and feed the medium; and a take-up part that rolls up and supports the medium after the layers are printed on the medium by the inkjet head.

3. The system for producing the multilayered printed matter according to claim 2, wherein the printing and cutting controller executes an operation to return the medium rolled up by the take-up part in the printing step to the feeding part in the cutting step.

4. The system for producing the multilayered printed matter according to claim 1, wherein the multilayered printed matter is formed by stacking a print layer including the pattern layer and the concealment layer, a seal layer, and a board in this order, and in the blade projection adjusting step, the blade projection is adjusted so that the print layer and the seal layer are thoroughly cut and the board is not thoroughly cut or only a part of the board is cut.

5. An apparatus for producing a multilayered printed matter for use in printing a multilayered printed matter in which layers are formed on a medium, the layers comprising:

two pattern layers with patterns formed thereon; and a concealment layer, the concealment layer being interposed between he two pattern layers so as to conceal one of the two pattern layers to be invisible from a side of the other one of the two pattern layers, the apparatus comprising:

an inkjet head that ejects ink to the medium to print the layers on the medium;

a medium cutting device that cuts the medium;

a moving device that causes relative movement between the medium, and the inkjet head and the medium cutting device; and a printing and cutting controller that controls operations to print the layers on the medium using the inkjet head and to cut the medium using the medium cutting device, the printing and cutting controller executing:

a printing step of moving the medium and the inkjet head relative to each other using the moving device and printing the two pattern layers and the concealment layer on the medium using the inkjet head, a cutting step, subsequent to the printing step, of moving the medium and the medium cutting device relative to each other using the moving device and cutting the medium using the medium cutting device, wherein the medium cutting device comprises a cutting blade used to cut the medium, a test printing step of printing, on the medium using the inkjet head, a group of print layers equal in thickness to an optional group of print layers in a portion of the multilayered printed matter to be cut in the cutting step, a test cutting step of inserting the cutting blade into the medium on which the test print is performed so as to cut the medium, and a blade protection adjusting step for adjusting blade prosection of blade based on the result of the test cut step.

* * * * *